US008144070B2

(12) United States Patent
Wright

(10) Patent No.: US 8,144,070 B2
(45) Date of Patent: Mar. 27, 2012

(54) PORTABLE YAGI ANTENNA KIT FOR BEING FREQUENCY/WAVELENGTH ADJUSTABLE BY VIRTUE OF BEING KNOCKDOWNABLE

(75) Inventor: Vernon L. Wright, Lincoln, CA (US)

(73) Assignee: Superantenna Corporation, San Mateo, CA (US)

( * ) Notice: Subject to any disclaimer, the term of this patent is extended or adjusted under 35 U.S.C. 154(b) by 419 days.

(21) Appl. No.: 12/460,874

(22) Filed: Jul. 24, 2009

(65) Prior Publication Data

US 2010/0277388 A1 Nov. 4, 2010

Related U.S. Application Data

(60) Provisional application No. 61/215,121, filed on May 1, 2009.

(51) Int. Cl.

| | |
|---|---|
| ***H01Q 21/12*** | (2006.01) |
| ***H01Q 21/00*** | (2006.01) |
| ***H01Q 19/10*** | (2006.01) |
| ***H01Q 19/30*** | (2006.01) |

(52) U.S. Cl. ..... 343/815; 343/817; 343/818; 343/819

(58) Field of Classification Search ..... 343/810, 343/812, 815, 817, 818, 819
See application file for complete search history.

(56) References Cited

U.S. PATENT DOCUMENTS

| | | | | |
|---|---|---|---|---|
| 2,941,204 | A | 6/1960 | Bailey | |
| 2,967,300 | A | 1/1961 | Haughawout | |
| 4,028,709 | A | 6/1977 | Berkowitz | |
| 5,521,608 | A | 5/1996 | Brandt | |
| 5,995,061 | A | 11/1999 | Schiller | |
| 6,154,180 | A | 11/2000 | Padrick | |
| 6,606,074 | B1 * | 8/2003 | Allnutt | 343/815 |
| 6,677,914 | B2 | 1/2004 | Mertel | |

* cited by examiner

*Primary Examiner* — Hoang V Nguyen

(57) ABSTRACT

A portable Yagi antenna kit for being frequency/wavelength adjustable by virtue of being knockdownable, wherein the Yagi antenna is for mounting to a mast. The antenna includes a boom, a reflector element, a driven element, and a director element. The reflector element, the driven element, and the director element each extend outwardly from the boom, respectively. The boom, the reflector element, the driven element, and the director element are each knockdownable so as to be portable and form the kit, and as such, are length adjustable, and as such, are frequency/wavelength adjustable.

96 Claims, 29 Drawing Sheets

70
76
78
34
72
74
36
54

70
76
78
34
72
74
36
A
54

110
114
112
118
116

8C
114
112
118
116
110
40

8D
122
124
114
120
110
118
116
40

122
56
124
126
110
122
124

176
178
170
180
174

176
13C
174
170
48

172
13D
186
184
176
182
178
180
174
170
48

188
186
172
184
170
172
186
184

METHOD OF ASSEMBLING THE PORTABLE YAGI ANTENNA KIT (20)
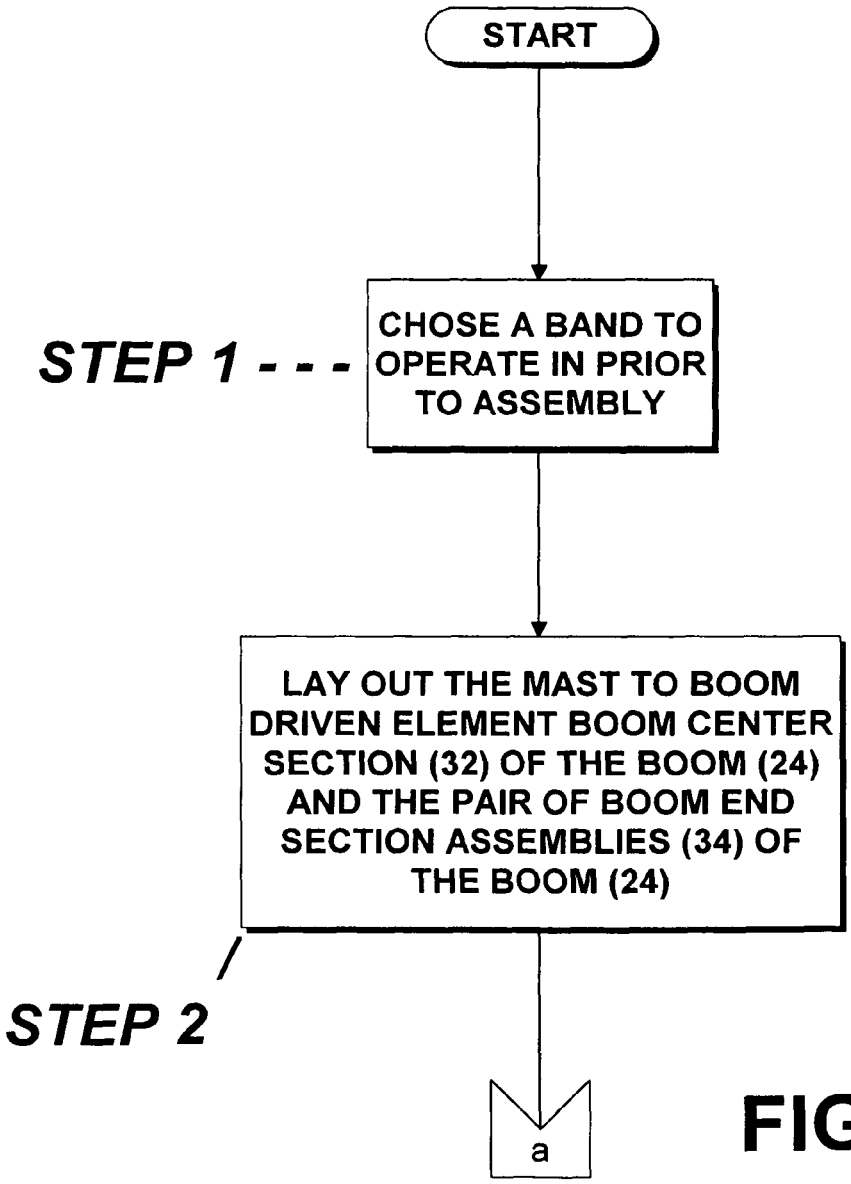
FIG. 17-A

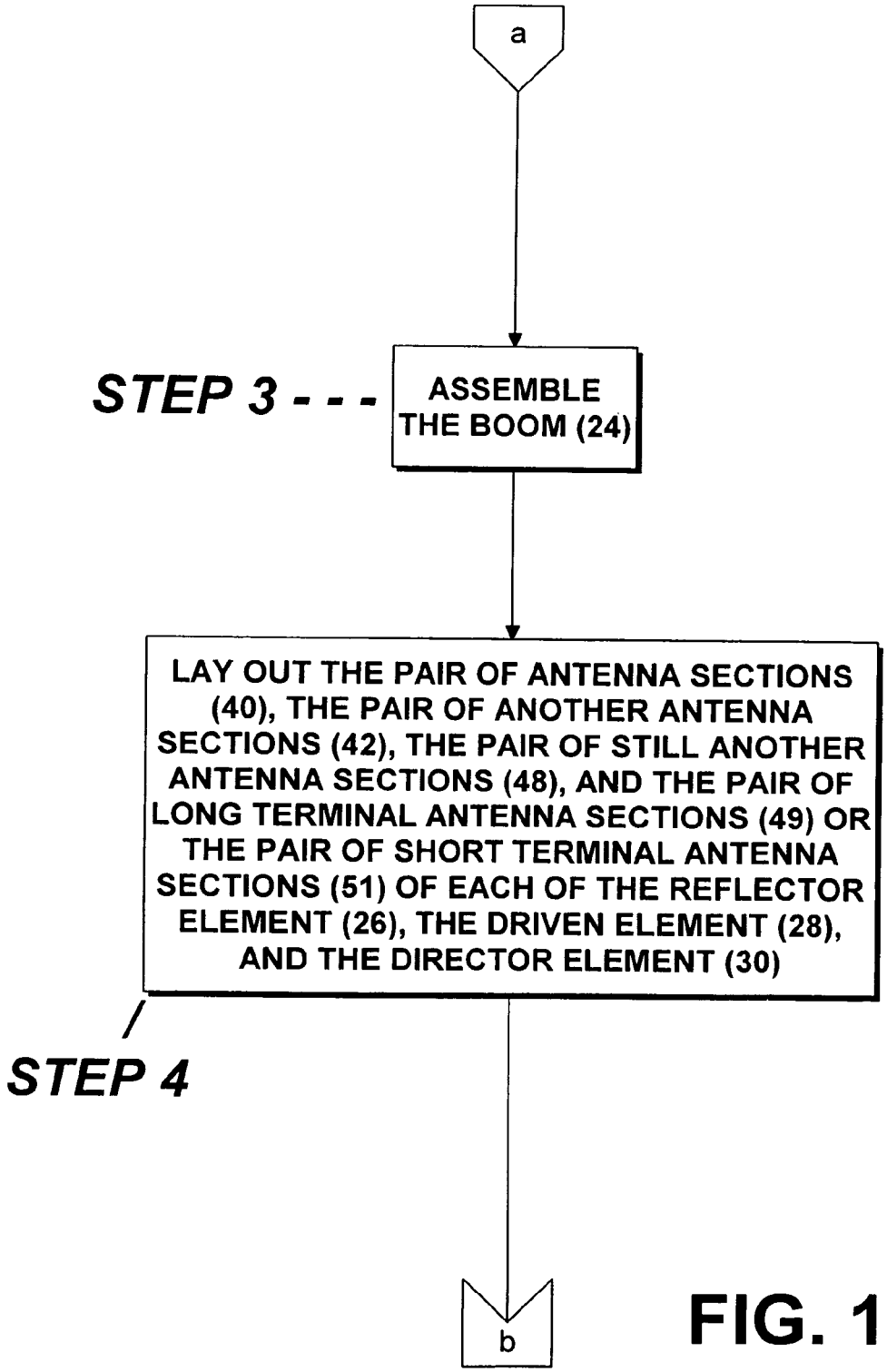
FIG. 17-B

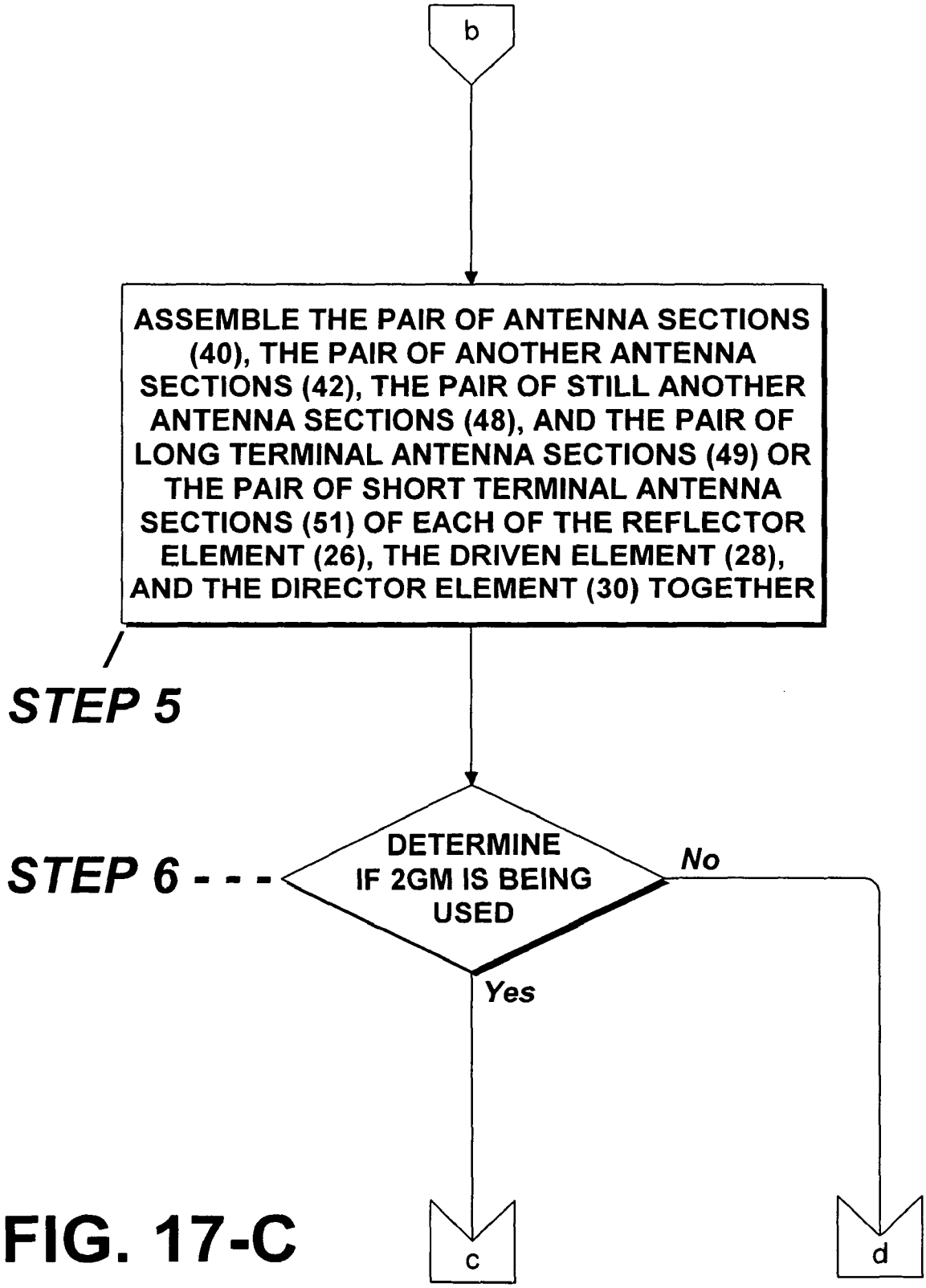
FIG. 17-C

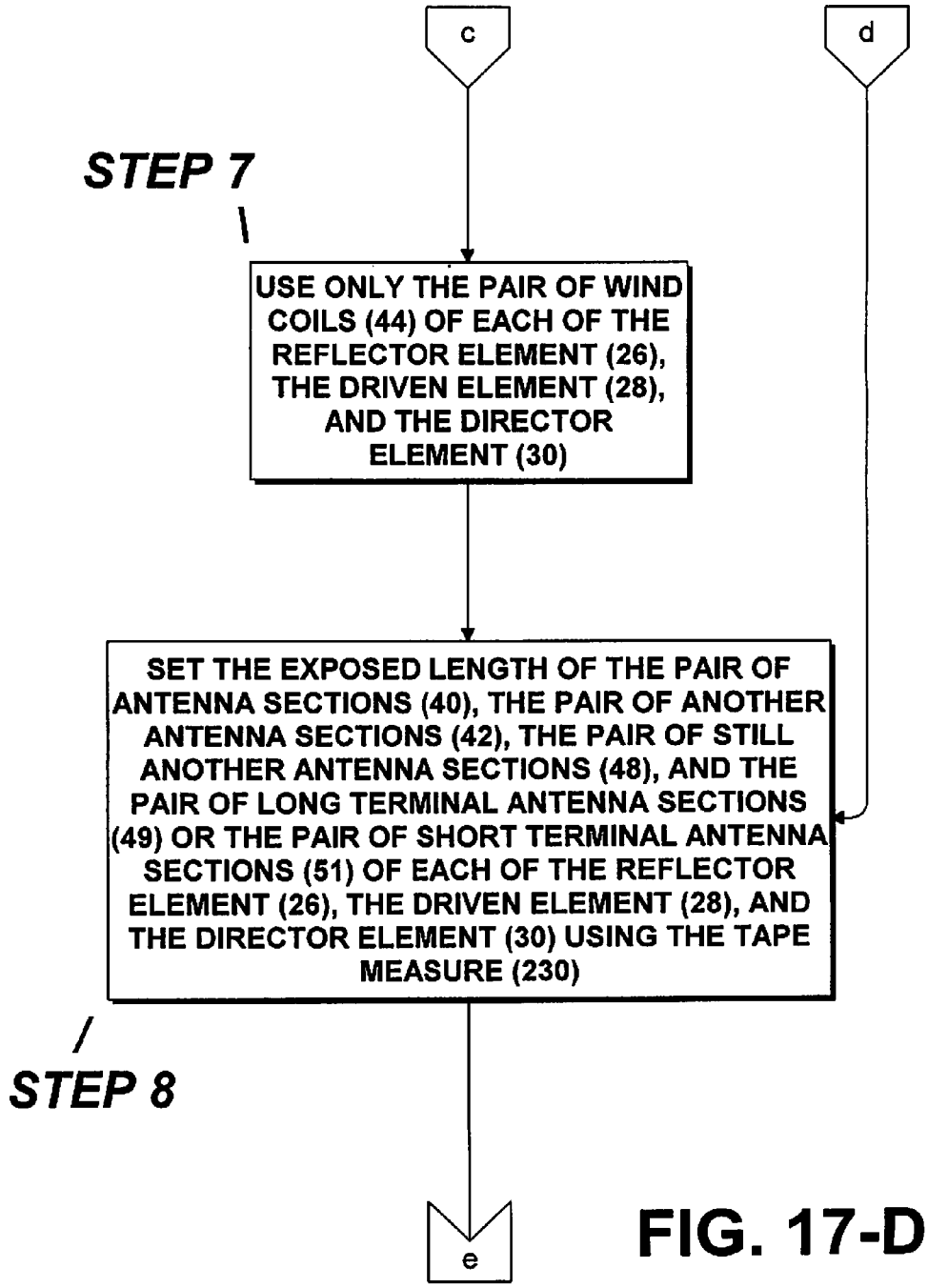
FIG. 17-D

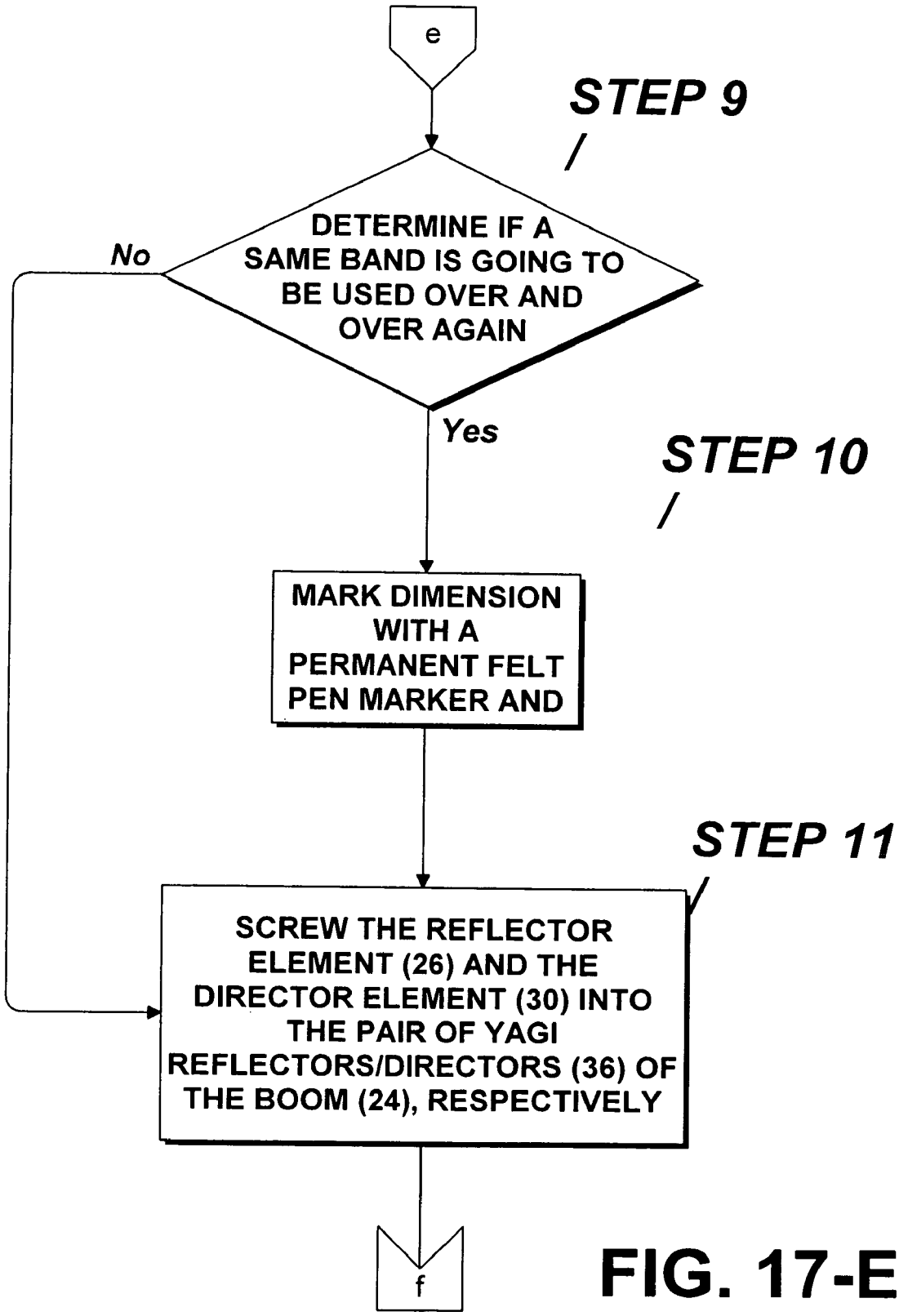
FIG. 17-E

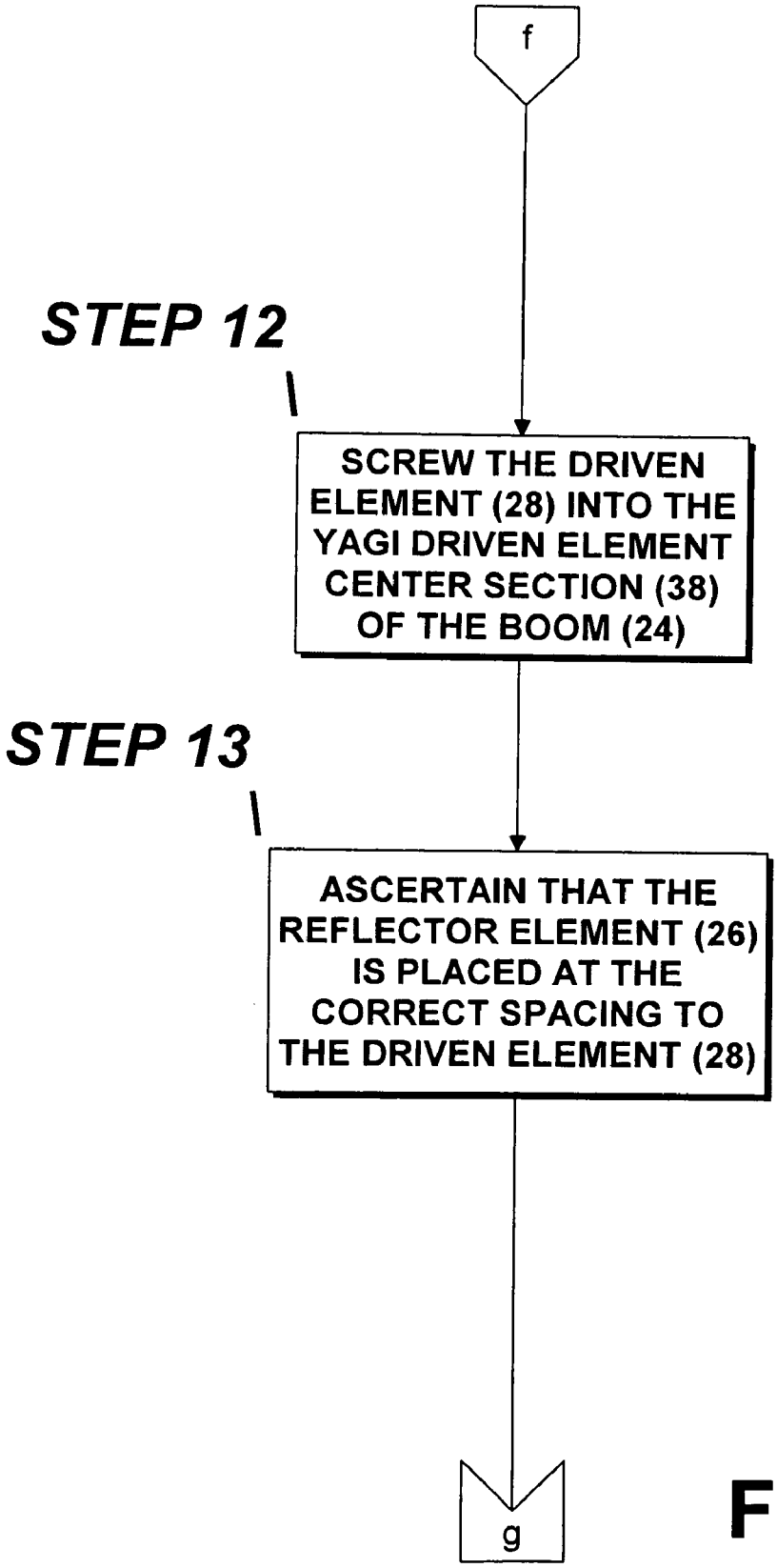
FIG. 17-F

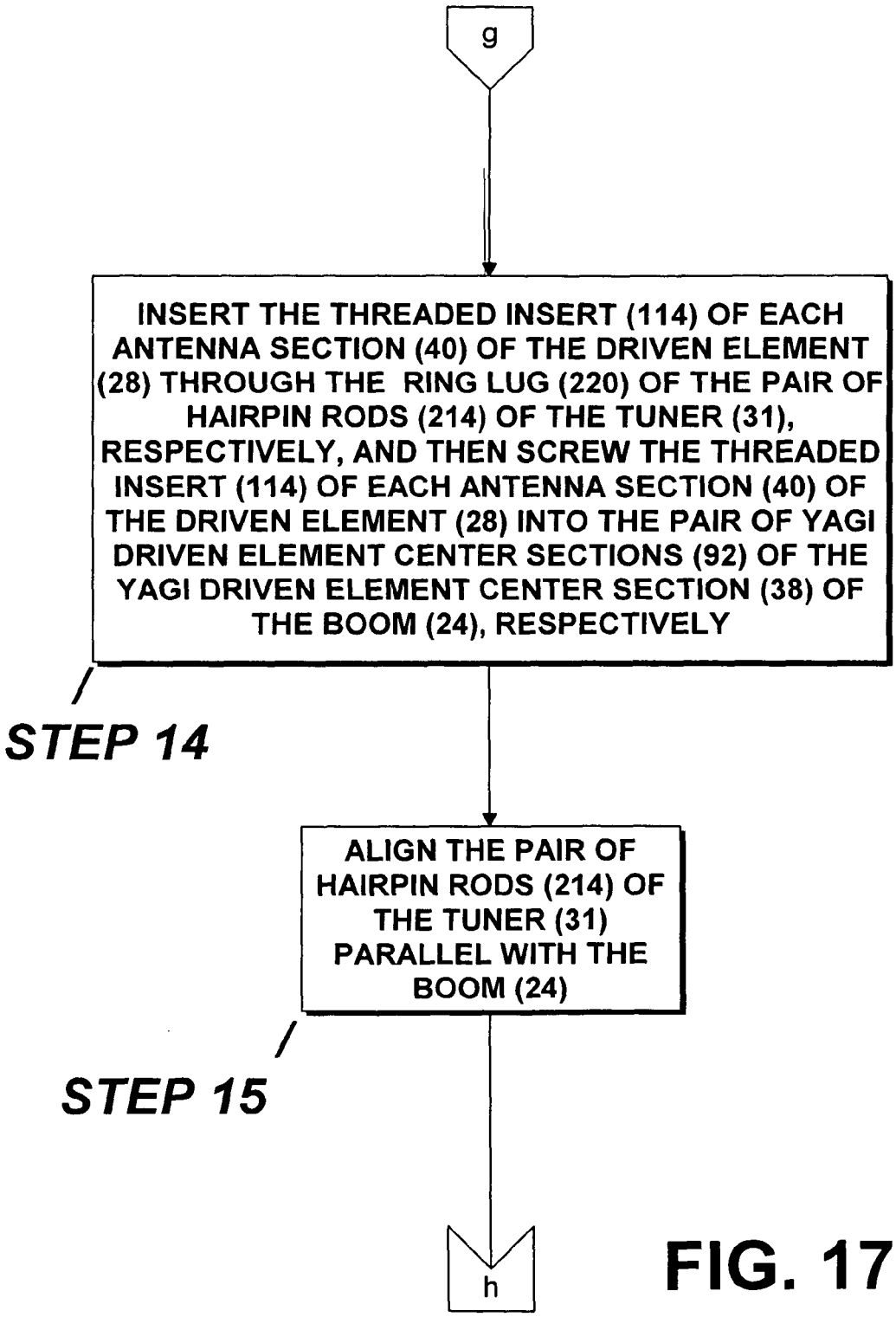
FIG. 17-G

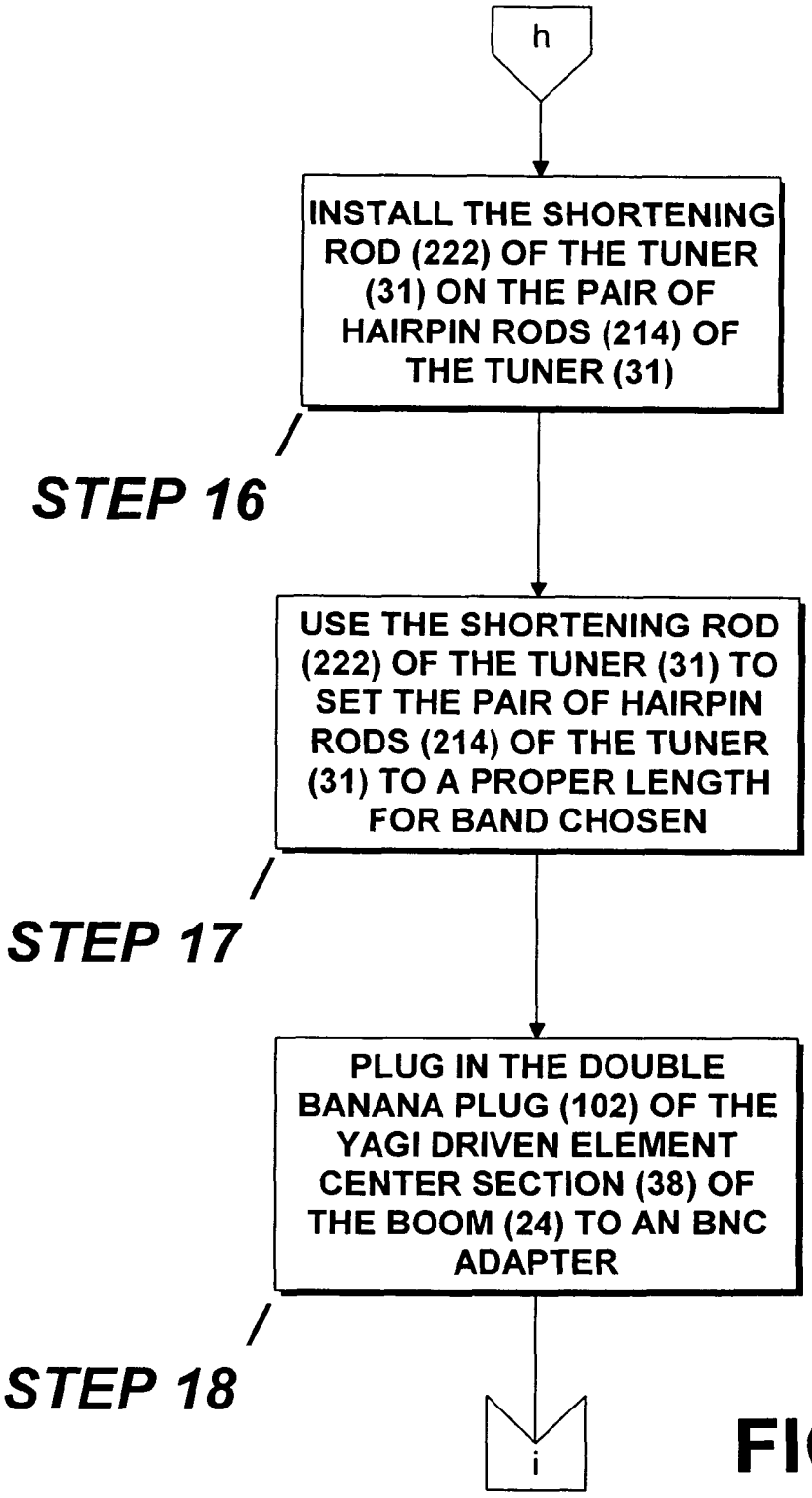
FIG. 17-H

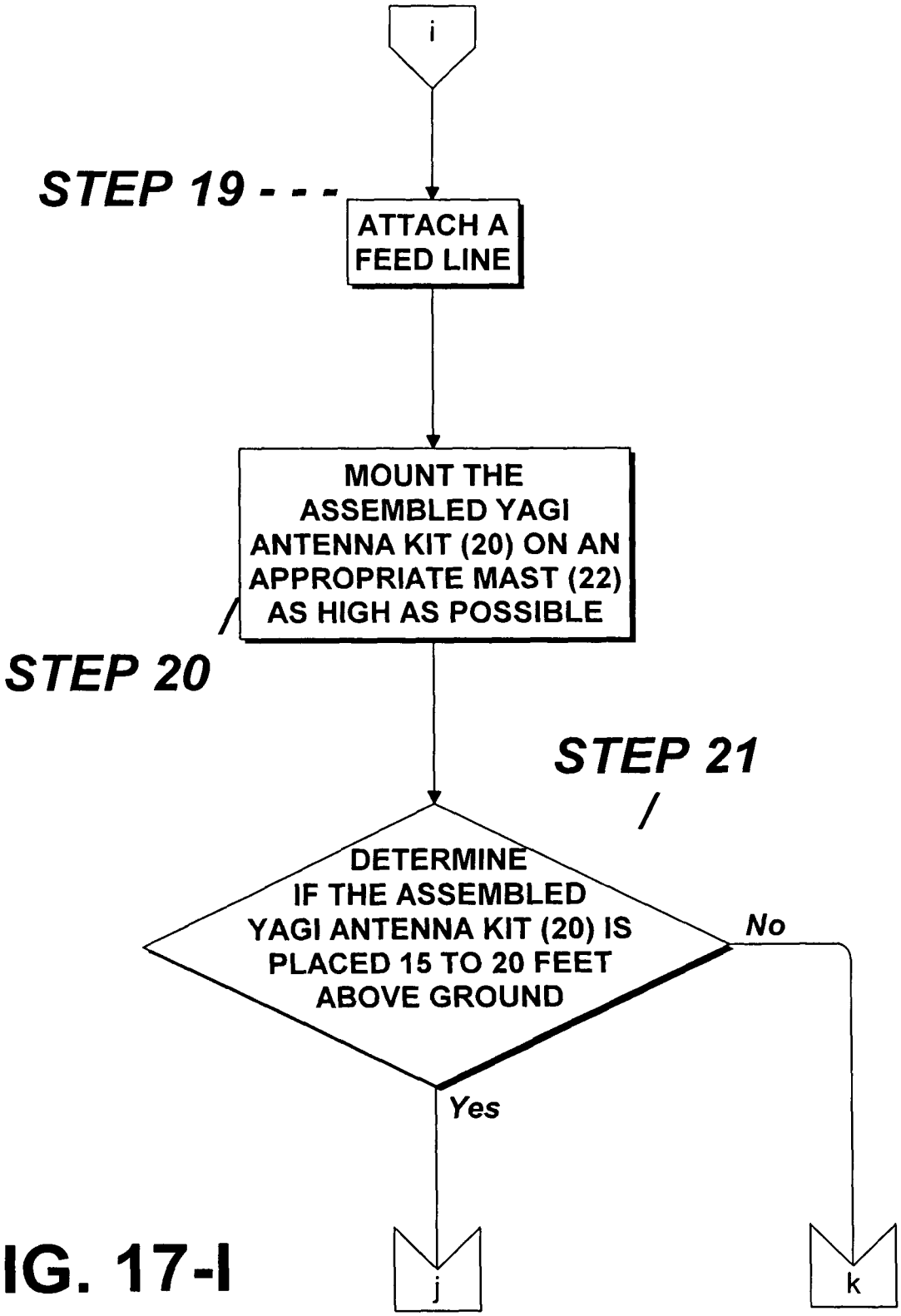
FIG. 17-I

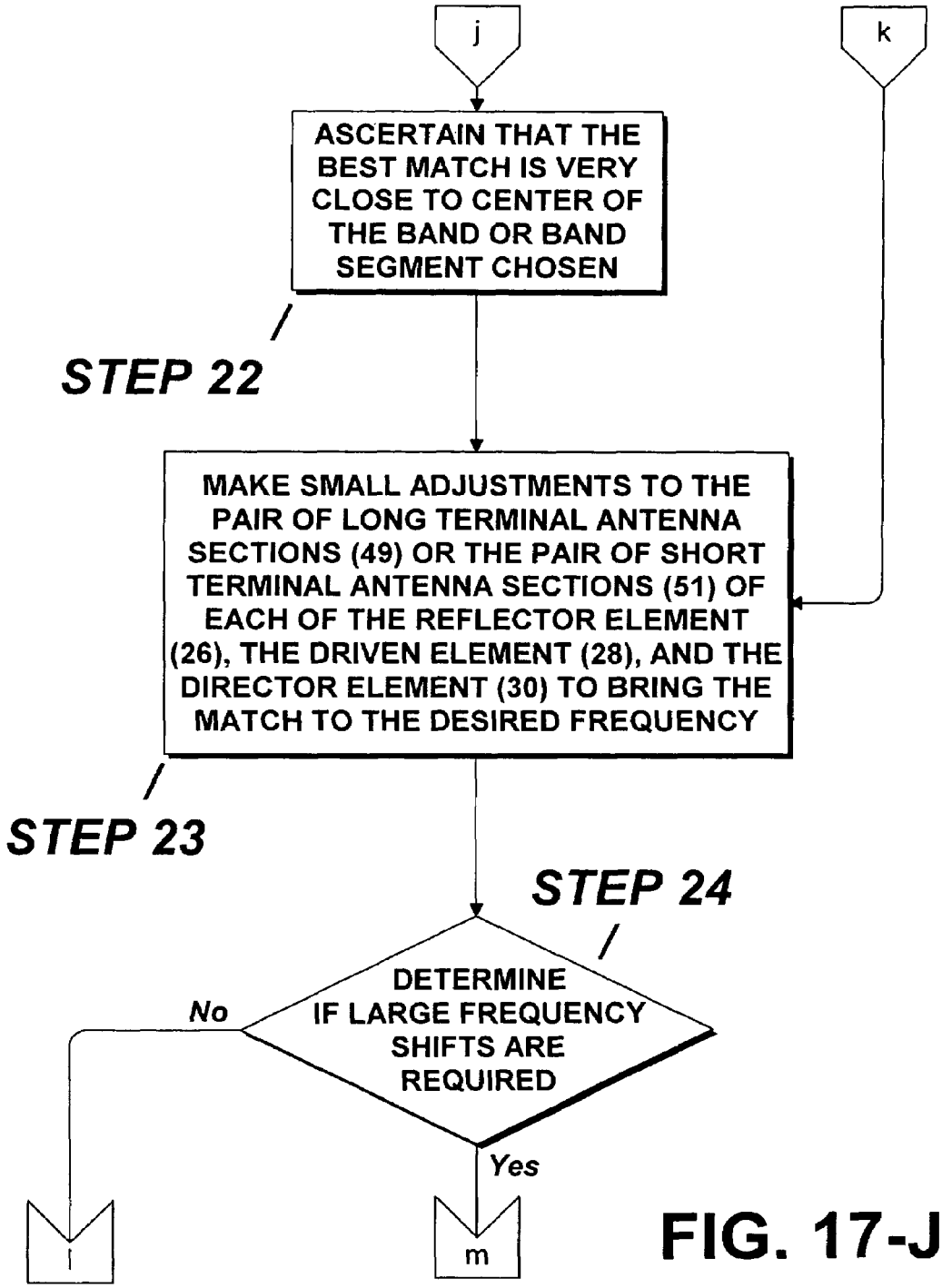
FIG. 17-J

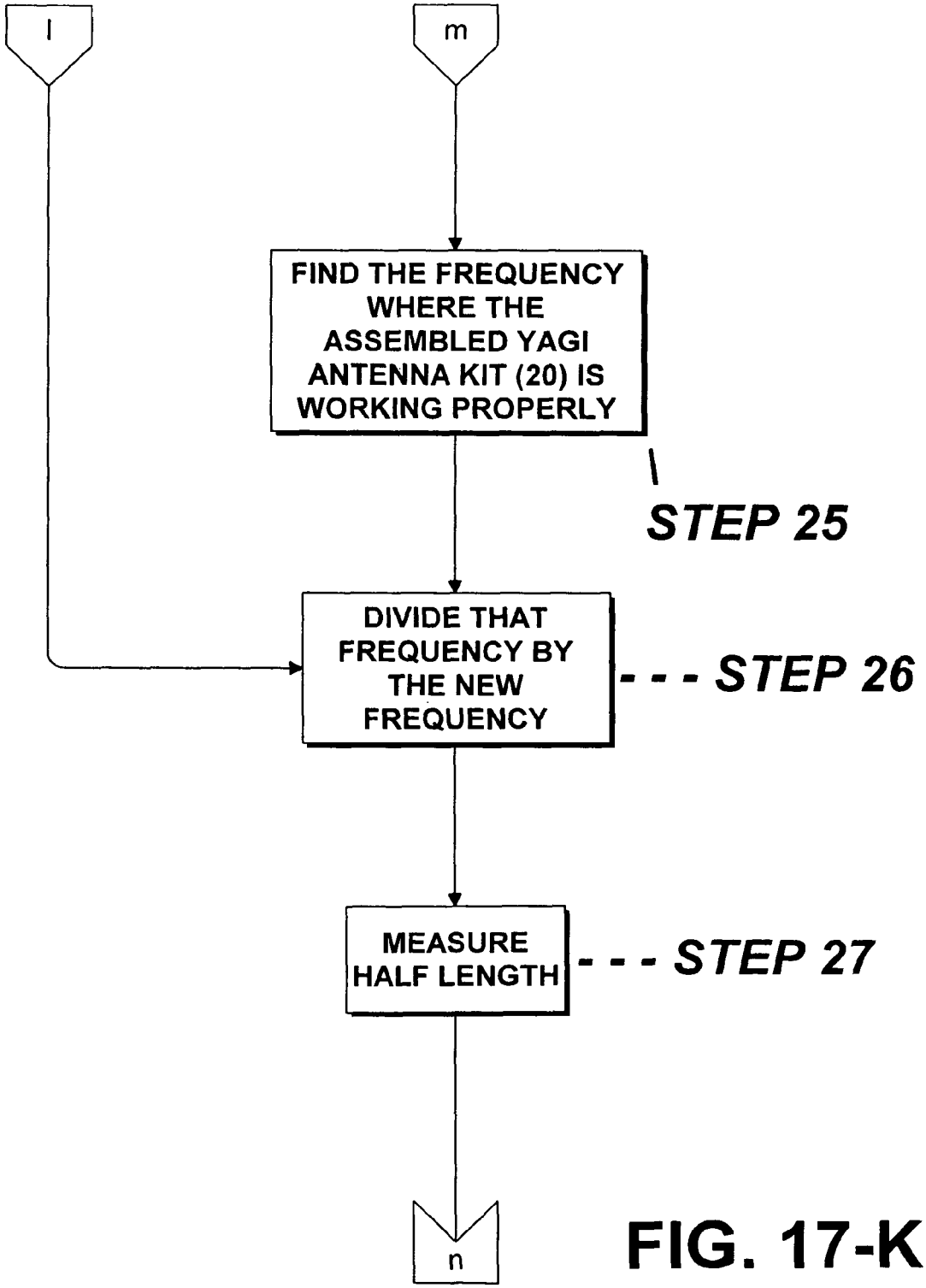
FIG. 17-K

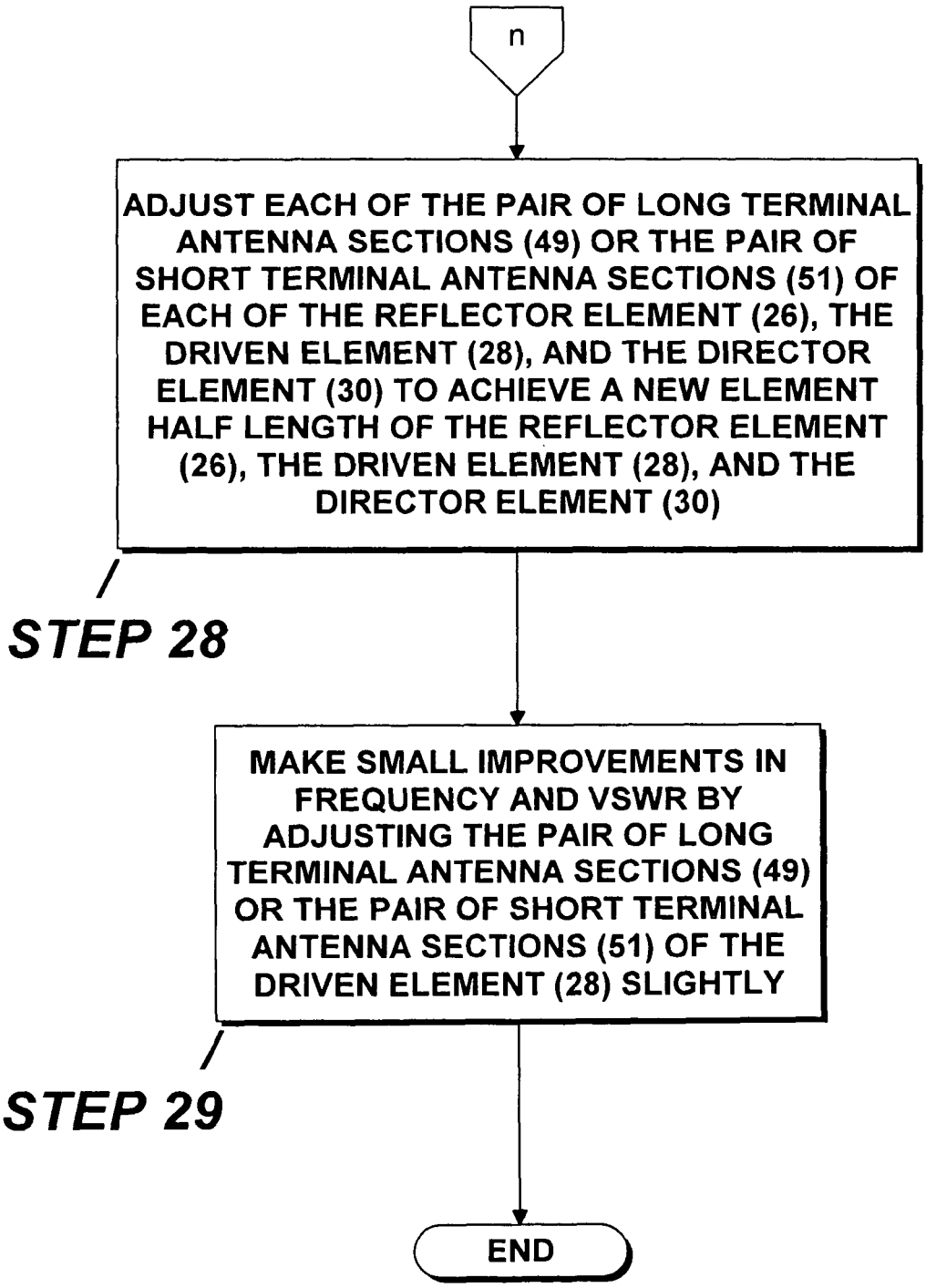
FIG. 17-L

YP3 QUICK ASSEMBLY GUIDE

PORTABLE YAGI ANTENNA KIT FOR BEING FREQUENCY/WAVELENGTH ADJUSTABLE BY VIRTUE OF BEING KNOCKDOWNABLE

CROSS REFERENCE TO RELATED APPLICATIONS

The instant application is a nonprovisional application of U.S. provisional application No. 61/215,121, filed on May 1, 2009, and entitled Portable, Compact, Easy to Assemble, Multi-band Configurable Yagi Antenna, and it is respectfully requested that this application be accorded the benefit under 35 USC 119(e) of said U.S. provisional application.

THE BACKGROUND OF THE INVENTION

A. The Field of the Invention

The embodiments of the present invention relate to a Yagi antenna, and more particularly, the embodiments of the present invention relate to a portable Yagi antenna kit for being frequency/wavelength adjustable by virtue of being knockdownable.

B. The Description of the Prior Art (1) General.

A Yagi-Uda Antenna, commonly known simply as a Yagi antenna or Yagi, is a directional antenna system[1] consisting of an array of a dipole and additional closely coupled parasitic elements—usually a reflector and one or more directors. The dipole in the array is driven, and another element, 10% longer, operates as a reflector. Other shorter parasitic elements are typically added in front of the dipole as directors. This arrangement gives the antenna directionality that a single dipole lacks.

[1] What is a Yagi-Uda antenna?—An explanation of the familiar Yagi-Uda antenna from a non-technical point of view. Includes information on wifi applications of Yagi Antennas.

Yagis are directional along the axis perpendicular to the dipole in the plane of the elements, from the reflector through the driven element and out via the director(s). If one holds out one's arms to form a dipole and has the reflector behind oneself, one would receive signals with maximum gain from in front of oneself.

Directional antennas, such as the Yagi-Uda, are also commonly referred to as beam antennas[2] or high-gain antennas—particularly for transmitting.

(2) Description.

Yagi-Uda antennas include one or more director elements, which, by virtue of their being arranged optimally at approximately a one-quarter-wavelength, mutual spacing and being progressively slightly shorter than a half wavelength, direct signals of increasingly higher frequencies onto the active dipole.

Thus, the complete antenna achieves a distinct response bandwidth determined by the length, diameter, and spacing of all the individual elements. But its overall gain is proportional to its length, rather than simply the number of elements.

All of the elements usually lie in the same plane, typically supported on a single boom or crossbar. The parasitic elements do not need to be coplanar, but can be distributed on both sides of the plane of symmetry.

The antenna gain is a function of the number of dipole elements and can be approximated—for the main lobe—as:

$$G_T=1.66*N$$

where N is the number of elements—dipoles—in the Yagi-Uda antenna.

Developed Yagi-Uda antennas are designed to operate on multiple bands. The resulting design is made more complicated by the presence of a resonant parallel coil and capacitor combination—called a "trap" or LC—in the elements.

Traps are used in pairs on a multi-band antenna. The trap serves to isolate the outer portion of the element from the inner portion for the trap design frequency.

In practice, the higher frequency traps are located closest to the boom of the antenna. Typically, a tri-band beam will have 2 pairs of traps per element. For example, a typical tri-band Yagi-Uda beam covering the 10, 15, and 20 meter bands would have traps for the 10 and 15 meter bands.

The introduction of traps is not without cost—due to their nature, they reduce the overall bandwidth of the antenna and overall efficiency of the array on any given frequency, and radically affect its response in the desired direction.

(3) History.

The Yagi-Uda antenna was invented in 1926 by Shintaro Uda of Tohoku Imperial University, Sendai, Japan, with the collaboration of Hidetsugu Yagi, also of Tohoku Imperial University. Yagi published the first English-language reference on the antenna in a 1928 survey article on short wave research in Japan and it came to be associated with his name. Yagi, however, always acknowledged Uda's principal contribution to the design, and the proper name for the antenna is, as above, the Yagi-Uda antenna—or array.

The Yagi was first widely used during World War II for airborne radar sets, because of its simplicity and directionality. Despite its being invented in Japan, many Japanese radar engineers were unaware of the design until very late in the war, due to internal fighting between the Army and Navy. The Japanese military authorities first became aware of this technology after the Battle of Singapore when they captured the notes of a British radar technician that mentioned "yagi antenna." Japanese intelligence officers did not even recognize that Yagi was a Japanese name in this context. When questioned, the technician said it was an antenna named after a Japanese professor—this story is analogous to the story of American intelligence officers interrogating German rocket scientists and finding out that Robert Goddard was the real pioneer of rocket technology even though he was not well known in the US at that time.

Yagi-Uda antennas are widely used by amateur radio operators worldwide for communication on frequencies from shortwave, through VHF/UHF, and into microwave bands. Hams often homebrew this type of antenna, and have provided many technical papers and software to the engineering community.

Hidetsugu Yagi attempted wireless energy transfer in February 1926 with this antenna. Yagi and Uda published their first report on the wave projector directional antenna. Yagi managed to demonstrate a proof of concept, but the engineering problems proved to be more onerous than conventional systems.

(4) Standing Wave Ratio.

In telecommunications, standing wave ratio ("SWR") is the ratio of the amplitude of a partial standing wave at an antinode—maximum—to the amplitude at an adjacent node—minimum—in an electrical transmission line.

The SWR is usually defined as a voltage ratio called the VSWR, for voltage standing wave ratio. For example, the VSWR value 1.2:1 denotes a maximum standing wave amplitude that is 1.2 times greater than the minimum standing wave value. It is also possible to define the SWR in terms of current, resulting in the ISWR, which has the same numerical value. The power standing wave ratio (PSWR) is defined as the square of the VSWR.

(5) Relationship to the Reflection Coefficient.

The voltage component of a standing wave in a uniform transmission line consists of the forward wave—with amplitude $V_f$—superimposed on the reflected wave—with amplitude $V_r$.

Reflections occur as a result of discontinuities, such as an imperfection in an otherwise uniform transmission line, or when a transmission line is terminated with other than its characteristic impedance. The reflection coefficient Γ is defined thus:

$$\Gamma = Vr/Vf$$

Γ is a complex number that describes both the magnitude and the phase shift of the reflection. The simplest cases, when the imaginary part of Γ is zero, are:

Γ=−−1: maximum negative reflection, when the line is short-circuited;

Γ=0: no reflection, when the line is perfectly matched; and

Γ=+1: maximum positive reflection, when the line is open-circuited.

For the calculation of VSWR, only the magnitude of Γ, denoted by ρ, is of interest. Therefore, we define:

$$\rho = |\Gamma|$$

At some points along the line the two waves interfere constructively, and the resulting amplitude $V_{max}$ is the sum of their amplitudes:

$$V_{max} = V_f + V_r = V_f + \rho V_f = V_f(1+\rho)$$

At other points, the waves interfere destructively, and the resulting amplitude $V_{min}$ is the difference between their amplitudes:

$$V_{min} = V_f - V_r = V_f \rho V_f = V_f(1-\rho)$$

The voltage standing wave ratio is then equal to:

$$\text{VSWR} = V_{max}/V_{min} = (1+\rho)/(1-\rho)$$

As ρ, the magnitude of Γ, always falls in the range [0,1], the VSWR is always≧+1.

The SWR can also be defined as the ratio of the maximum amplitude of the electric field strength to its minimum amplitude, i.e. $E_{max}/E_{min}$.

(6) Further Analysis.

To understand the standing wave ratio in detail, we need to calculate the voltage—or, equivalently, the electrical field strength—at any point along the transmission line at any moment in time. We can begin with the forward wave, whose voltage as a function of time t and of distance x along the transmission line is:

$$V_f(x,t) = A \sin(\omega t - kx)$$

where A is the amplitude of the forward wave, ω is its angular frequency, and k is a constant—equal to ω divided by the speed of the wave. The voltage of the reflected wave is a similar function, but spatially reversed—the sign of x is inverted—and attenuated by the reflection coefficient ρ:

$$V_f(x,t) = \rho A \sin(\omega t + kx)$$

The total voltage $V_t$ on the transmission line is given by the superposition principle, which is just a matter of adding the two waves:

$$V_f(x,t) = A \sin(\omega t - kx) + \rho A \sin(\omega t + kx)$$

Using standard trigonometric identities, this equation can be converted to the following form:

$$Vt(x,t) + A\sqrt{[(4\rho \cos^2 kx) + (1-\rho)^2]} \cos(\omega t + \phi)$$

$$\text{where: } \tan \phi = [(1+\rho)(1-\rho)] \cot(kx)$$

This form of the equation shows, if we ignore some of the details, that the maximum voltage over time $V_{mot}$ at a distance x from the transmitter is the periodic function.

$$V_{mot} = A\sqrt{[4\rho \cos^2 kx + (1-\rho)^2]}$$

This varies with x from a minimum of A(1−ρ) to a maximum of A(1+ρ), as we saw in the earlier, simplified discussion.

(7) Practical Implications of SWR.

The most common case for measuring and examining SWR is when installing and tuning transmitting antennas. When a transmitter is connected to an antenna by a feed line, the impedance of the antenna and feed line must match exactly for maximum energy transfer from the feed line to the antenna to be possible. The impedance of the antenna varies based on many factors including: the antenna's natural resonance at the frequency being transmitted, the antenna's height above the ground, and the size of the conductors used to construct the antenna.[2]

[2] Hutchinson, Chuck, ed. (2000). *The ARRL Handbook for Radio Amateurs* 2001. Newington, Conn.: ARRL—The National Association for Amateur Radio. pp. g. 20.2. ISBN 0-87259-186-7.

When an antenna and feedline do not have matching impedances, some of the electrical energy cannot be transferred from the feedline to the antenna.[3] Energy not transferred to the antenna is reflected back towards the transmitter.[4] It is the interaction of these reflected waves with forward waves which causes standing wave patterns.[5] Reflected power has two main implications in radio transmitters: Radio Frequency (RF) energy losses increase,[6] and damage to the transmitter can occur.[7]

[3] Hutchinson, Chuck, ed. (2000). *The ARRL Handbook for Radio Amateurs* 2001. Newington, Conn.: ARRL—The National Association for Amateur Radio. pp. 19.4-19.6. ISBN 0-87259-186-7.

[4] Ford, Steve (April 1997). "The SWR Obsession" (PDF). *QST* (Newington, Conn.: ARRL—The National Association for Amateur Radio. 78 (4): 70-72. Retrieved on Sep. 26, 2008.

[5] See footnote 3.

[6] Id.

[7] Hutchinson, Chuck, ed. (2000). *The ARRL Handbook for Radio Amateurs* 2001. Newington, Conn.: ARRL—The National Association for Amateur Radio. pp. g. 19.13. ISBN 0-87259-186-7.

Matching the impedance of the antenna to the impedance of the feed line is typically done using an antenna tuner. The tuner can be installed between the transmitter and the feed line, or between the feed line and the antenna. Both installation methods will allow the transmitter to operate at a low SWR, however, if the tuner is installed at the transmitter, the feed line between the tuner and the antenna will still operate with a high SWR, causing additional RF energy to be lost through the feedline.

Many amateur radio operators believe any impedance mismatch is a serious matter.[8] This, however, is not the case. Assuming the mismatch is within the operating limits of the transmitter, the radio operator needs only be concerned with the power loss in the transmission line. Power loss will increase as the SWR increases, however, the increases are often less than radio amateurs assume. For example, a dipole antenna tuned to operate at 3.75 MHz—the center of the 80 meter amateur radio band—will exhibit an SWR of about 6:1 at the edges of the band. If, however, the antenna is fed with 250 feet of RG-8A coax, the loss due to standing waves is only 2.2 dB.[9] Feed line loss typically increases with frequency, so VHF and above antennas must be matched closely to the feedline. The same 6:1 mismatch to 250 feet of RG-8A coax would incur 10.8 dB of loss at 146 MHz.[10]

[8] See footnote 2.

[9] See footnote 3.

[10] Id.

Numerous innovations for antennas have been provided in the prior art, which will be described below in chronological order to show advancement in the art, and which are incorporated herein by reference thereto. Even though these innovations may be suitable for the specific individual purposes to which they address, however, they differ from the present invention in that they do not teach a portable Yagi antenna kit for being frequency/wavelength adjustable by virtue of being knockdownable.

(8) The U.S. Pat. No. 2,941,204 to Bailey.

The U.S. Pat. No. 2,941,204 issued to Bailey on Jun. 14, 1960 in U.S. class 343 and subclass 713 teaches an arrangement for supporting and for end-feeding an antenna, which includes an antenna element that is substantially a half wave length long, apparatus defining a ground plane, and cooperating and supporting apparatus for holding the element with its longitudinal axis generally perpendicular and with its lower end spaced from the plane. The coupling and supporting apparatus includes a resonant transformer coupled to the lower end of the antenna element and adapted to apply voltage thereto at an impedance substantially matched to that of the element. The outside surface of the coupling and supporting apparatus is conductive and has a length above the ground plane so that the surface is non-resonant at the frequency of operation whereby the radiation characteristic of the antenna is not adversely affected by the presence of the coupling and supporting apparatus.

(9) The U.S. Pat. No. 2,967,300 to Haughawout.

The U.S. Pat. No. 2,967,300 issued to Haughawout on Jan. 3, 1961 in U.S. class 343 and subclass 750 teaches a multiple band antenna including a plurality of coaxially related radiating elements of graduated length. Each of the radiating elements is shaped to radiate signals having different frequencies. At least one coaxial tuning sleeve is arranged to telescope between the radiating elements for isolating the signal frequencies radiated by one radiating element from the adjacent element.

(10) The U.S. Pat. No. 4,028,709 to Berkowitz et al.

The U.S. Pat. No. 4,028,709 issued to Berkowitz et al. on Jun. 7, 1977 in U.S. class 343 and subclass 819 teaches yagi antenna having a director element, a half-wave active dipole element, and a reflector element mounted on an antenna boom. All antenna elements are rods that are telescopically adjustable in length from a collapsible position to an operating length for a predetermined frequency of operation, and are removable from threaded mounting for storage. The director element and reflector element are slidably adjustable on the antenna boom for independent spacing with respect to the half-wave active dipole element. The antenna boom has two mast support holes, one for horizontal polarization and the other for vertical polarization. A ferrite core member surrounds a coaxial cable connecting the half-wave active dipole element to a coaxial connector, and provides balun action between the coaxial cable and a balanced antenna feed point.

(11) The U.S. Pat. No. 5,521,608 to Brandt et al.

The U.S. Pat. No. 5,521,608 issued to Brandt et al. on May 28, 1996 in U.S. class 343 and subclass 349 teaches a multiband direction finding antenna including numerous antenna elements of coplanar location. The antenna elements associated with lower band frequencies are provided with chokes so that unchoked sections do not exceed one-quarter wavelength of the high-band highest frequency.

(12) The U.S. Pat. No. 5,995,061 to Schiller.

The U.S. Pat. No. 5,995,061 issued to Schiller on Nov. 30, 1999 in U.S. class 343 and subclass 815 teaches a no-loss, multi-band, adaptable Yagi style antenna employing a multi-element driven cell having a center element and one or more adjacent elements on each side of the center element. The adjacent elements of the driven cell are electrically shorter than the center element, thereby permitting the driven cell to be tuned to two or more frequency bands. The antenna is fed by a feedline connected to a common feed point at the center of the center element in the driven cell. Parasitic director elements are positioned in front of the driven cell and are tuned to the highest band of the driven cell. Parasitic reflector elements for one or more frequency bands are positioned behind the driven cell, with these elements tuned to actual operating frequencies of the antenna. A multi-band dipole antenna array covers three or more frequency bands, which includes a set of dipole elements having a center element and one or more adjacent elements and one or more adjacent elements on each side of the center element. The adjacent elements are electrically shorter than the center element and are of unequal lengths. The antenna is fed by a feedline connected to a common feedpoint at the center of the center element of the set of dipole elements. Parasitic director elements are positioned in front of the set of dipole elements, and parasitic reflector elements are positioned behind the set of dipole elements.

(13) The U.S. Pat. No. 6,154,180 to Padrick.

The U.S. Pat. No. 6,154,180 issued to Padrick on Nov. 28, 2000 in U.S. class 343 and subclass 722 teaches a parasitic antenna array (Yagi-Uda or loop type) for multiple frequency bands, which has its driven and parasitic elements interlaced on a single support boom. In a first aspect, series resonant circuits are located in one or more parasitic director elements in order to minimize the deleterious mutual coupling effect between directors of different frequency bands. In a second aspect, an inductance is placed across the feed point of the driven element of one or more non-selected frequency bands in order to minimize the bandwidth narrowing effect of closely-spaced driven elements and to provide a desired feed point impedance at the driven element of the selected frequency band. Although, the two aspects may be used without one another, they are advantageously employed together. In addition, the second aspect may be applied to closely-spaced driven elements that are not part of a parasitic array.

(14) The U.S. Pat. No. 6,677,914 to Mertel.

The U.S. Pat. No. 6,677,914 issued to Mertel on Jan. 13, 2004 in U.S. class 343 and subclass 815 teaches an antenna system with at least one tunable dipole element with a length adjustable conductive member disposed therein that enables the antenna to be used over a wide range of frequencies. The element is made of two longitudinally aligned, hollow support arms made of non-conductive material. Disposed longitudinally inside each element, is a length adjustable conductive member electrically connected at one end. In the preferred embodiment, each conductive member is stored on a spool that is selectively rotated to precisely extend the conductive member into the support arm. The support arms that may be fixed or adjustable in length are affixed at one end to a rigid housing. During use, the conductive members are adjusted in length to tune the element to a desired frequency. The antenna is especially advantageous when configured as a Yagi-style antenna that can be optimally tuned at a specific frequency for maximum gain, maximum front-to-back ratio, and to provide a desired feed point impedance at the driven element. The antenna can also function as a bi-directional antenna by adjusting the reflector element to function as a director. An electronic control system allows the length of the conductive members to be manually or automatically adjusted to a desired frequency.

It is apparent that numerous innovations for antennas have been provided in the prior art that are adapted to be used.

Furthermore, even though these innovations may be suitable for the specific individual purposes to which they address, however, they would not be suitable for the purposes of the embodiments of the present invention as heretofore described, namely, a portable Yagi antenna kit for being frequency/wavelength adjustable by virtue of being knockdownable.

THE SUMMARY OF THE INVENTION

Thus, an object of the embodiments of the present invention is to provide a portable Yagi antenna kit for being frequency/wavelength adjustable by virtue of being knockdownable, which avoids the disadvantages of the prior art.

Briefly stated, another object of the embodiments of the present invention is to provide a portable Yagi antenna kit for being frequency/wavelength adjustable by virtue of being knockdownable, wherein the Yagi antenna is for mounting to a mast. The antenna includes a boom, a reflector element, a driven element, and a director element. The reflector element, the driven element, and the director element each extend outwardly from the boom, respectively. The boom, the reflector element, the driven element, and the director element are each knockdownable so as to be portable and form the kit, and as such, are length adjustable, and as such, are frequency/wavelength adjustable.

The embodiments of the present invention are a lightweight, extremely flexible beam antenna designed for field applications by the QRP operator and others. The antenna provides forward gain and directivity on all band 20M through 6M using an ingenious combination of parts that one adjusts in the field with almost no tools. When placed on a common push-up or similar mast at least 20 feet tall, the antenna will provide the benefits of directional reception and transmission. Yet one may carry the antenna in a 3 foot long bag with great ease as one moves from home to field and back again. In operation, the antenna expands to a maximum side-to-side width of about 220 inches and a maximum length of less than 120 inches. The estimated power limit of the antenna is 500 Watts.

The field Yagi of the embodiments of the present invention is a 3 element Yagi optimized within its design for use on a wide range of frequencies. The Yagi 3 element design provides wide bandwidth on each band for each field adjustments. One only needs to set and measure the element lengths and coils according to the instructions for each band. One may even vary the recommended dimensions for special circumstances and the instructions will provide one with some guidelines.

For 6 meter operation, the boom must be shortened and the elements greatly reduced in length but it is now a full size Yagi with good gain and F/B on the bottom of the band 50.0 to 50.5 mHz. CW operation is 50.0 to 50.100 normally. 50.110 is the international SSB and CW calling frequency. 50.125 is the beginning of the stateside phone band. Normally SSB contacts inside the USA are not done below 50.125. The 6 m beacon band is 50.0 to 50.080.

On 10 meters one has a full size Yagi that covers the bottom 1 mHz with one setting. Boom length is set to maximum and no coils are required. Gain and F/B are excellent.

On 17 and 12 meters mid element coils are used to resonate the elements and the antenna will cover the full amateur band. One will experience good gain and F/B on both bands.

20 and 15 meters are much wider bands, therefore the coil loaded elements require two settings per band. The gain arid F/B on 15 m is close to that of a full size Yagi. On 20 m the reduced size of the antenna for portable work will provide good directivity and F/B offering improved communications over a dipole at the same height.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

THE BRIEF DESCRIPTION OF THE DRAWING

The figures of the drawing are briefly described as follows:

FIG. 17A-17L are a flow chart of the method of assembling the portable Yagi antenna kit.

THE LIST OF REFERENCE NUMERALS UTILIZED IN THE DRAWING

Figure 1:
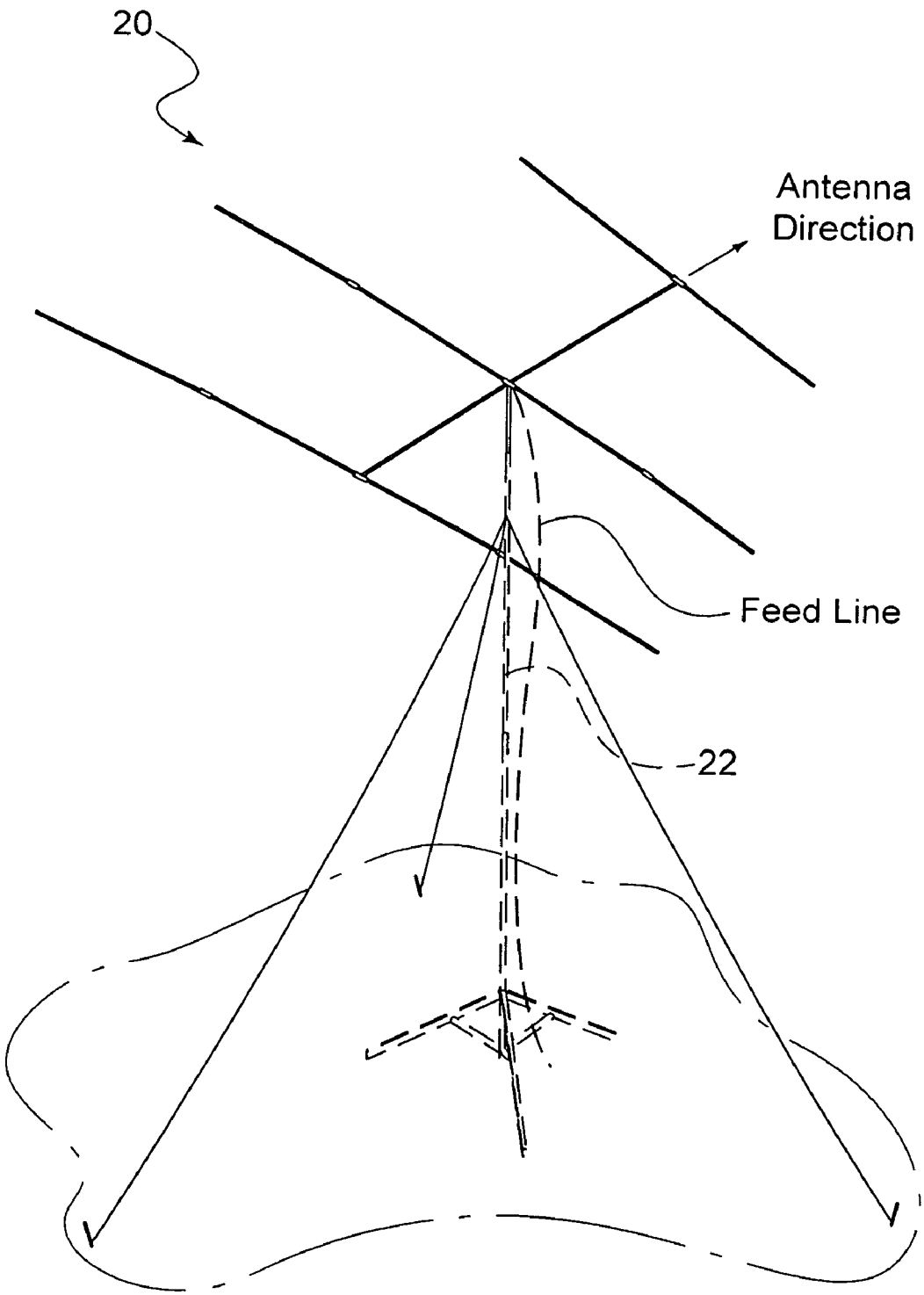
FIG. 1 is a diagrammatic perspective view of the portable Yagi antenna kit of the embodiments of the present invention utilizing a tripod mast.

A. General.

20 portable Yagi antenna kit of embodiments of present invention for being frequency/wavelength adjustable by virtue of being knockdownable

22 mast

B. Overall Configuration of Portable Yogi Antenna Kit 20.

24 boom

26 reflector element

28 driven element

30 director element

31 tuner

32 mast to boom driven element boom center section of boom 24

34 pair of boom end section assemblies of boom 24

36 pair of Yagi reflectors/directors of boom 24

38 Yagi driven element center element of boom 24

40 pair of antenna sections of each of reflector element 26, driven element 28, and director element 30

42 another pair of antenna sections of each of reflector element 26, driven element 28, and director element 30

44 pair of wound coils of each of reflector element 26, driven element 28, and director element 30

46 pair of couplings of each of reflector element 26, driven element 28, and director element 30

48 still another pair of antenna sections of each of reflector element 26, driven element 28, and director element 30

49 pair of long terminal antenna sections of each of reflector element 26, driven element 28, and director element 30

50 mast to boom assembly of boom 24

51 pair of short terminal antenna sections of each of reflector element 26, driven element 28, and director element 30

52 ends of mast to boom driven element boom center section 32 of boom 24

54 outboard ends of pair of boom end section assemblies 34 of boom 24, respectively

56 outboard ends of pair of antenna sections 40 of each of reflector element 26, driven element 28, and director element 30, respectively

60 outboard ends of another pair of antenna sections 42 of each of reflector element 26, driven element 28, and director element 30, respectively

62 outboard ends of pair of wound coils 44 of each of reflector element 26, driven element 28, and director element 30, respectively

64 outboard ends of pair of couplings 46 of each of reflector element 26, driven element 28, and director element 30, respectively C. Specific Configuration of Mast to Boom Driven Element Boom Center Section 32 of Boom 24.

68 boom center section tube of mast to boom driven element boom center section 32 of boom 24

D. Specific Configuration of Pair of Boom End Section Assemblies 34 of Boom 24.

70 boom end section tube of each boom end section assembly of pair of boom end section assemblies 34 of boom 24

72 pair of stainless steel screws of boom end section tube 70 of each boom end section assembly of pair of boom end section assemblies 34 of boom 24

74 pair of stainless steel nuts of boom end section tube 70 of each boom end section assembly of pair of boom end section assemblies 34 of boom 24

76 pair of pin spring locks of boom end section tube 70 of each boom end section assembly of pair of boom end section assemblies 34 of boom 24

78 inboard ends of pair of boom end section assemblies 34 of boom 24, respectively E. Specific Configuration of Pair of Yagi Reflectors/Directors 36 of Boom 24.

80 dipole end section of each Yagi reflector/director of pair of Yagi reflectors/directors 36 of boom 24

82 through bore in dipole end section 80 of each Yagi reflector/director of pair of Yagi reflectors/directors 36 of boom 24

84 Yagi reflector/director end section of each Yagi reflector/director of pair of Yagi reflectors/directors 36 of boom 24

86 bracket of each Yagi reflector/director of pair of Yagi reflectors/directors 36 of boom 24

F. Specific Configuration of Yagi Driven Element Center Section 38 of Boom 24.

88 dipole center section of Yagi driven element center section 38 of boom 24

90 through bore in dipole center section 88 of Yagi driven element center section 38 of boom 24

92 pair of Yagi driven element center sections of Yagi driven element center section 38 of boom 24

94 bracket of Yagi driven element center section 38 of boom 24

96 pair of pins of Yagi driven element center section 38 of boom 24

98 first pair of bores in dipole center section 88 of Yagi driven element center section 38 of boom 24

100 first bore in each of pair of Yagi driven element center sections 92 of Yagi driven element center section 38 of boom 24

102 double banana plug of Yagi driven element center section 38 of boom 24

104 pair of pins of double banana plug 102 of Yagi driven element center section 38 of boom 24

106 second pair of bores in dipole center section 88 of Yagi driven element center section 38 of boom 24

108 second bore 108 in each of pair of Yagi driven element center sections 92 of Yagi driven element center section 38 of boom 24, respectively G. Specific Configuration of Pair of Antenna Sections 40 of Each of Reflector Element 26, Driven Element 28, and Director Element 30.

110 tube of each antenna section of pair of antenna sections 40 of each of reflector element 26, driven element 28, and director element 30, respectively

112 inboard end of tube 110 of each antenna section of pair of antenna sections 40 of each of reflector element 26, driven element 28, and director element 30, respectively

114 threaded insert of each antenna section of pair of antenna sections 40 of each of reflector element 26, driven element 28, and director element 30, respectively,

116 roll pin in inboard end 112 of associated antenna section of pair of antenna sections 40 of each of reflector element 26, driven element 28, and director element 30, respectively

118 bore in inboard end 112 of associated antenna section of pair of antenna sections 40 of each of reflector element 26, driven element 28, and director element 30, respectively

120 bore in threaded insert 114 of associated antenna section of pair of antenna sections 40 of each of reflector element 26, driven element 28, and director element 30, respectively

122 collar of each antenna section of pair of antenna sections 40 of each of reflector element 26, driven element 28, and director element 30, respectively

124 thumb screw of each antenna section of pair of antenna sections 40 of each of reflector element 26, driven element 28, and director element 30, respectively

126 bore in collar 122 of associated antenna section of pair of antenna sections 40 of each of reflector element 26, driven element 28, and director element 30, respectively H. Specific Configuration of Pair of Another Antenna Sections 42 of Each of Reflector Element 26, Driven Element 28, and Director Element 30.

128 tube of each another antenna section of pair of antenna sections 42 of each of reflector element 26, driven element 28, and director element 30, respectively

130 inboard end of tube 128 of each another antenna section of pair of antenna sections 42 of each of reflector element 26, driven element 28, and director element 30, respectively

132 threaded insert of each another antenna section of pair of antenna sections 42 of each of reflector element 26, driven element 28, and director element 30, respectively

134 roll pin in outboard end 60 of associated another antenna section of pair of another antenna sections 42 of each of reflector element 26, driven element 28, and director element 30, respectively

136 bore in out board end 60 of associated another antenna section of pair of antenna sections 42 of each of reflector element 26, driven element 28, and director element 30, respectively

138 bore in threaded insert 132 of associated another antenna section of pair of antenna sections 42 of each of reflector element 26, driven element 28, and director element 30, respectively I. Specific Configuration of Pair of Wound Coils 44 of Each of Reflector Element 26, Driven Element 28, and Director Element 30.

140 Yagi coil tube of each wound coil of pair of wound coils 44 of each of reflector element 26, driven element 28, and director element 30

142 pair of ends of Yagi coil tube 140 of each wound coil of pair of wound coils 44 of each of reflector element 26, driven element 28, an d director element 30.

144 wire coil of each wound coil of pair of wound coils 44 of each of reflector element 26, driven element 28, and director element 30

146 pair of looped ends of wire coil 144 of each wound coil of pair of wound coils 44 of each of reflector element 26, driven element 28, and director element 30

148 pair of screws of each wound coil of pair of wound coils 44 of each of reflector element 26, driven element 28, and director element 30

150 pair of bores in Yagi coil tube 140 of each wound coil of pair of wound coils 44 of each of reflector element 26, driven element 28, and director element 30

152 pair of coil end caps of each wound coil of pair of wound coils 44 of each of reflector element 26, driven element 28, and director element 30

154 diametrically-opposed and radially-oriented bores in each coil end cap of pair of coil end caps 152 of each wound coil of pair of wound coils 44 of each of reflector element 26, driven element 28, and director element 30

J. Specific Configuration of Pair of Coil End Caps 152 of Each Wound Coil of Pair of Wound Coils 44 of Each of Reflector Element 26, Driven Element 28, and Director Element 30.

156 plug of each coil end cap of pair of coil end caps 152 of each wound coil of pair of wound coils 44 of each of reflector element 26, driven element 28, and director element 30

158 flange of each coil end cap of pair of coil end caps 152 of each wound coil of pair of wound coils 44 of each of reflector element 26, driven element 28, and director element 30

160 outboard end of each coil end cap of pair of coil end caps 152 of each wound coil of pair of wound coils 44 of each of reflector element 26, driven element 28, and director element 30

162 threaded through bore in each coil end cap of pair of coil end caps 152 of each wound coil of pair of wound coils 44 of each of reflector element 26, driven element 28, and director element 30

K. Specific Configuration of Pair of Couplings 46 of Each of Reflector Element 26, Driven Element 28, and Director Element 30, Respectively.

164 sleeve of each coupling of pair of couplings 46 of each of reflector element 26, driven element 28, and director element 30, respectively

166 pair of threaded bores in each coupling of pair of couplings 46 of each of reflector element 26, driven element 28, and director element 30, respectively

168 inboard end of sleeve 164 of each coupling of pair of couplings 46 of each of reflector element 26, driven element 28, and director element 30, respectively L. Specific Configuration of Pair of Still Another Antenna Sections 48 of Each of Reflector Element 26, Driven Element 28, and Director Element 30.

170 tube of each still another antenna section of pair of still another antenna sections 48 of each of reflector element 26, driven element 28, and director element 30

172 outboard end of tube 170 of each still another antenna section of pair of still another antenna sections 48 of each of reflector element 26, driven element 28, and director element 30

174 inboard end of tube 170 of each still another antenna section of pair of still another antenna sections 48 of each of reflector element 26, driven element 28, and director element 30

176 threaded insert of each still another antenna section of pair of still another antenna sections 48 of each of reflector element 26, driven element 28, and director element 30

178 roll pin in inboard end 174 of an associated still another antenna section of pair of still another antenna sections 48 of each of reflector element 26, driven element 28, and director element 30

180 bore in inboard end 174 of associated still another antenna section of pair of still another antenna sections 48 of each of reflector element 26, driven element 28, and director element 30

182 bore in threaded insert 176 of associated still another antenna section of pair of still another antenna sections 48 of each of reflector element 26, driven element 28, and director element 30

184 collar of each still another antenna section of pair of still another antenna sections 48 of each of reflector element 26, driven element 28, and director element 30

186 thumb screw of each still another antenna section of pair of still another antenna sections 48 of each of reflector element 26, driven element 28, and director element 30

188 bore in collar 184 of associated still another antenna section of pair of still another antenna sections 48 of each of reflector element 26, driven element 28, and director element 30

M. Specific Configuration of Mast to Boom Assembly 50 of Boom 24.

190 boom mounting plate of mast to boom assembly 50 of boom 24

192 two pair of primary through bores in boom mounting plate 190 of mast to boom assembly 50 of boom 24

194 two pair of secondary through bores in boom mounting plate 190 of mast to boom assembly 50 of boom 24

196 pair of boom clamps of mast to boom assembly 50 of boom 24

197 boom facing side of boom mounting plate 190 of mast to boom assembly 50 of boom 24

198 two pair of screws of pair of boom clamps 196 of mast to boom assembly 50 of boom 24, respectively

200 two pair of washers of pair of boom clamps 196 of mast to boom assembly 50 of boom 24, respectively

202 pair of clamp screws of pair of boom clamps 196 of mast to boom assembly 50 of boom 24, respectively

204 through bores in pair of boom clamps 196 of mast to boom assembly 50 of boom 24, respectively

206 pair of U-bolts of mast to boom assembly 50 of boom 24

208 pair of clamp bases of mast to boom assembly 50 of boom 24

210 two pair of nuts of mast to boom assembly 50 of boom 24

212 mast facing side of boom mounting plate 190 of mast to boom assembly 50 of boom 24

N. Specific Configuration of Tuner 31.

214 pair of hairpin rods of tuner 31

216 inboard end of each hairpin rod of pair of hairpin rods 214 of the tuner 31

218 outboard end of each hairpin rod of pair of hairpin rods 214 of the tuner 31

220 ring lug of inboard end 216 of each hairpin rod of pair of hairpin rods 214 of tuner 31

222 shortening rod of tuner 31

224 pair of through bores in shortening rod 222 of tuner 31

226 pair of thumb wheels of shortening rod 222 of tuner 31

O. Carrying Case 228 and Tape Measure 230.

228 carrying case

230 tape measure

THE DETAILED DESCRIPTION OF THE PREFERRED EMBODIMENTS

A. General.

Figure 2:
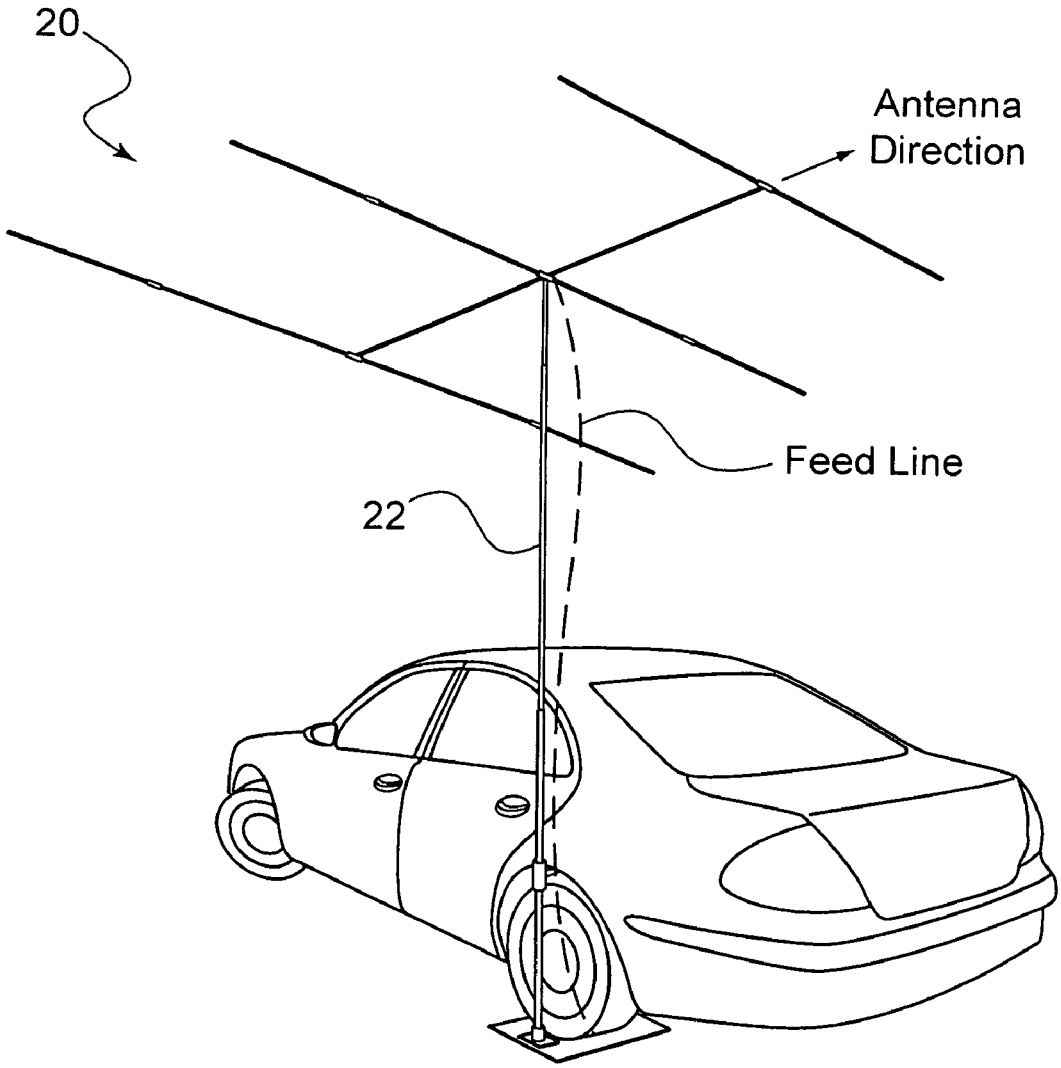
FIG. 2 is a diagrammatic perspective view of the portable Yagi antenna kit of the embodiments of the present invention utilizing a based mast.

Referring now to the figures, in which like numerals indicate like parts, and particularly to FIGS. 1 and 2, which are, respectively, a diagrammatic perspective view of the portable Yagi antenna kit of the embodiments of the present invention utilizing a tripod mast, and a diagrammatic perspective view of the portable Yagi antenna kit of the embodiments of the present invention utilizing a based mast, the portable Yagi antenna kit of the embodiments of the present invention is shown generally at 20 for being frequency/wavelength adjustable by virtue of being knockdownable, wherein the Yagi antenna 20 is for mounting to a mast 22.

B. The Overall Configuration of the Portable Yogi Antenna Kit 20.

The overall configuration of the Yogi antenna 20 can best be seen in FIG. 3, which is an enlarged diagrammatic top plan view taken generally in the direction of ARROW 3 in FIGS. 1 and 2 of the portable Yagi antenna kit of the embodiments of the present invention, and as such, will be discussed with reference thereto.

The Yogi antenna kit 20 comprises a boom 24, a reflector element 26, a driven element 28, and a director element 30. The reflector element 26, the driven element 28, and the director element 30 extend outwardly from the boom 24, respectively. The boom 24, the reflector element 26, the driven element 28, and the director element 30 are each knockdownable so as to be portable and form the kit 20, and as such, are length adjustable, and as such, are frequency/wavelength adjustable.

The Yogi antenna kit 20 further comprises a tuner 31. The tuner 31 extends from the driven element 28 in a general direction of the boom 24.

The boom 24 comprises a mast to boom driven element boom center section 32, a pair of boom end section assemblies 34, a pair of Yagi reflectors/directors 36, and a Yagi driven element center element 38.

The reflector element 26, the driven element 28, and the director element 30 each comprises a pair of antenna sections 40 and another pair of antenna sections 42.

The reflector element 26, the driven element 28, and the director element 30 each further comprise a pair of one of wound coils 44 and couplings 46.

The reflector element 26, the driven element 28, and the director element 30 each further comprise a still another pair of antenna sections 48 and one of a pair of long terminal antenna sections 49 and a pair of short terminal antenna sections 51.

The boom 24 further comprises a mast to boom assembly 50.

The pair of boom end section assemblies 34 of the boom 24 extend telescopically from ends 52 of the mast to boom driven element boom center section 32 of the boom 24, respectively.

The pair of Yagi reflectors/directors 36 of the boom 24 are disposed on outboard ends 54 of the pair of boom end section assemblies 34 of the boom 24, respectively.

The Yagi driven element center element 38 of the boom 24 is disposed generally centrally on the mast to boom driven element boom center section 32 of the boom 24.

The pair of antenna sections 40 of each of the reflector element 26, the driven element 28, and the director element 30 extend threadably from the pair of Yagi reflectors/directors 36 of the boom 24 and the Yagi driven element center element 38 of the boom 24, respectively.

The another pair of antenna sections 42 of each of the reflector element 26, the driven element 28, and the director element 30 extend telescopically from outboard ends 56 of the pair of antenna sections 40 of each of the reflector element 26, the driven element 28, and the director element 30, respectively.

The pair of wound coils 44 extend threadably from outboard ends 60 of the another pair of antenna sections 42 of each of the reflector element 26, the driven element 28, and the director element 30, respectively.

In the alternative, the pair of couplings 46 extend threadably from the outboard ends 60 of the another pair of antenna sections 42 of each of the reflector element 26, the driven element 28, and the director element 30, respectively.

The still another pair of antenna sections 48 extend threadably from outboard ends 62 of the pair of wound coils 44 of each of the reflector element 26, the driven element 28, and the director element 30, respectively.

In the alternative, the still another pair of antenna sections 48 extend threadably from outboard ends 64 of the pair of couplings 46 of each of the reflector element 26, the driven element 28, and the director element 30, respectively.

C. The Specific Configuration of the Mast to Boom Driven Element Boom Center Section 32 of the Boom 24.

The specific configuration of the mast to boom driven element boom center section 32 of the boom 24 can best be seen in FIG. 4, which is an enlarged diagrammatic perspective view of the mast to boom driven element boom center section of the portable Yagi antenna kit of the embodiments of the present invention identified by ARROW 4 in FIG. 3, and as such, will be discussed with reference thereto.

The mast to boom driven element boom center section 32 of the boom 24 comprises a boom center section tube 68. The boom center section tube 68 of the boom 24 has the ends 52 of the mast to boom driven element boom center section 32 of the boom 24, and is made from aluminum.

The Yagi driven element center element 38 of the boom 24 is disposed generally centrally on the boom center section tube 68 of the mast to boom driven element boom center section 32 of the boom 24.

The mast to boom assembly 50 of the boom 24 is disposed adjacent to the Yagi driven element center element 38 of the boom 24.

D. The Specific Configuration of the Pair of Boom End Section Assemblies 34 of the Boom 24.

Figure 3:
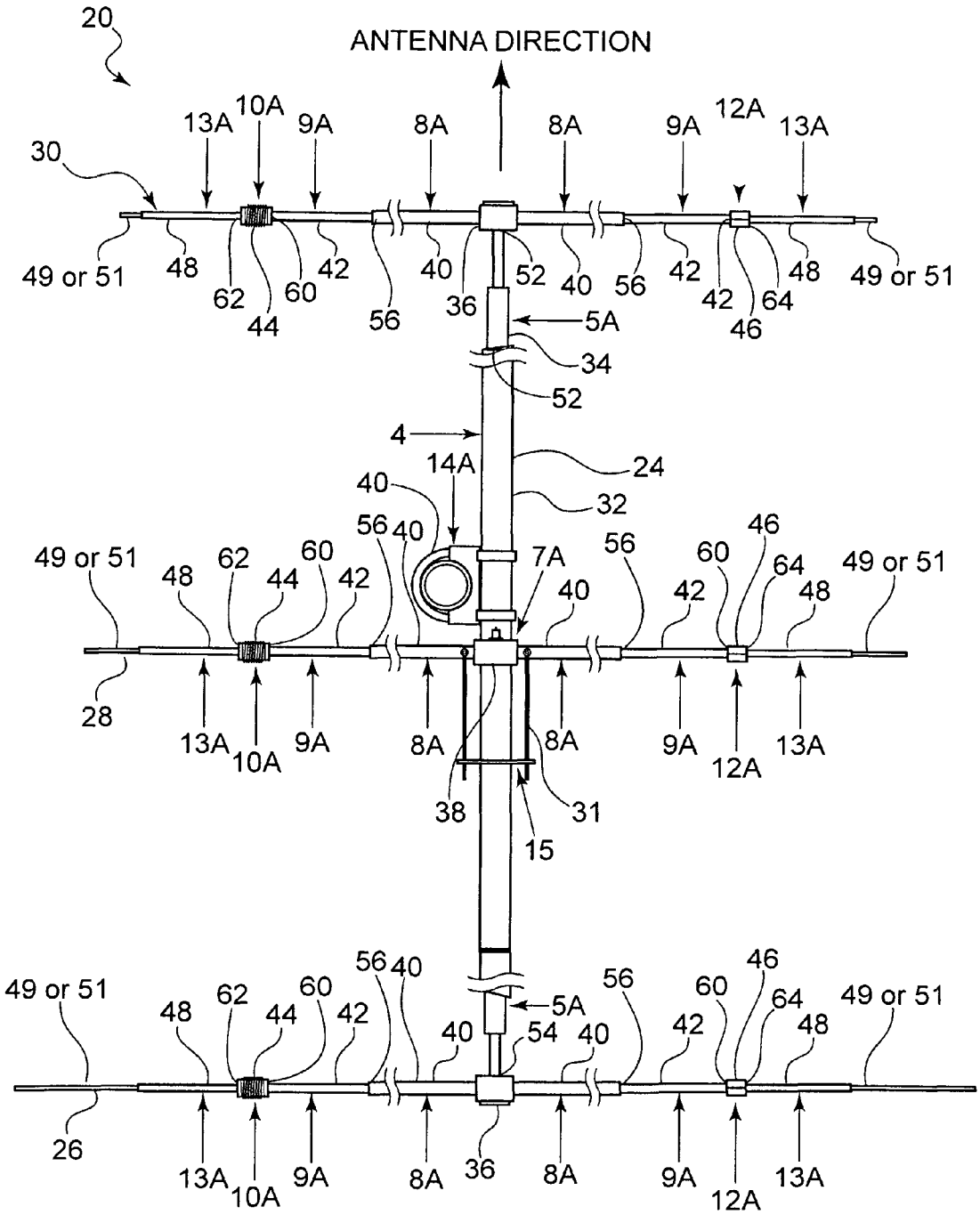
FIG. 3 is an enlarged diagrammatic top plan view taken generally in the direction of ARROW 3 in FIGS. 1 and 2 of the portable Yagi antenna kit of the embodiments of the present invention.
Figure 4:
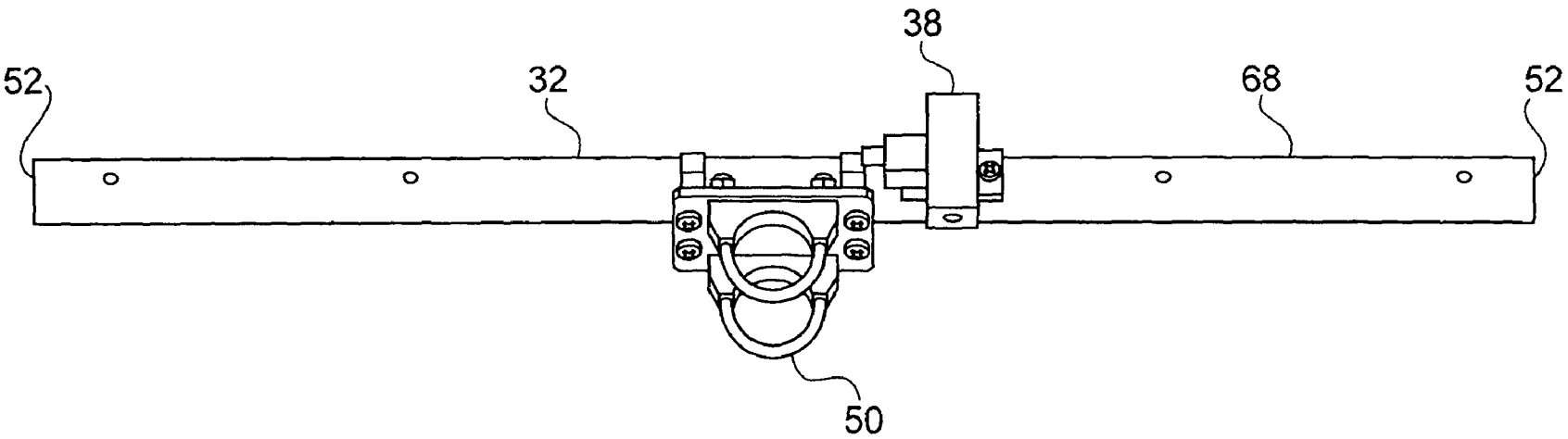
FIG. 4 is an enlarged diagrammatic perspective view of the mast to boom driven element boom center section of the portable Yagi antenna kit of the embodiments of the present invention identified by ARROW 4 in FIG. 3.
Figures 5A, 5B:
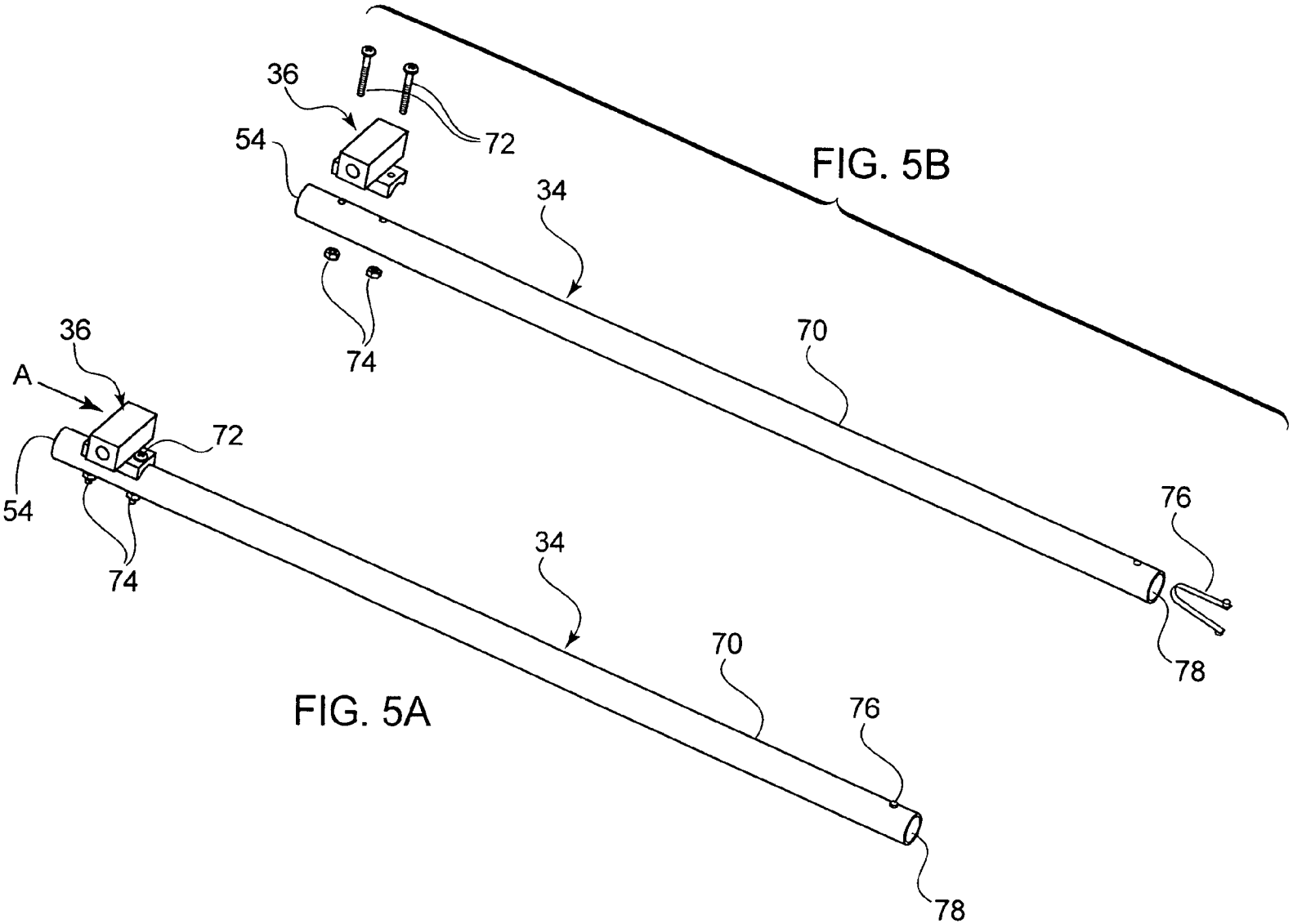
FIG. 5A is an enlarged diagrammatic perspective view of the boom end section assembly of the portable Yagi antenna kit of the embodiments of the present invention identified by ARROW 5A in FIG. 3.
FIG. 5B is an exploded diagrammatic perspective view of the boom end section assembly of the portable Yagi antenna kit of the embodiments of the present invention shown in FIG. 5A.

The specific configuration of the pair of boom end section assemblies 34 of the boom 24 can best be seen in FIGS. 5A and 5B, which are, respectively, an enlarged diagrammatic perspective view of the boom end section assembly of the portable Yagi antenna kit of the embodiments of the present invention identified by ARROW 5A in FIG. 3, and an exploded diagrammatic perspective view of the boom end section assembly of the portable Yagi antenna kit of the embodiments of the present invention shown in FIG. 5A, and as such, will be discussed with reference thereto.

The pair of boom end section assemblies 34 of the boom 24 each comprises a boom end section tube 70. Each boom end section tube 70 of the boom 24 has the outboard end 54 of the pair of boom end section assemblies 34 of the boom 24, and is made from aluminum.

The pair of Yagi reflectors/directors 36 of the boom 24 are disposed on the pair of boom end section tubes 70 of the boom 24, respectively, at the outboard end 54 of the pair of boom end section assemblies 34 of the boom 24, respectively, by a pair of stainless steel screws 72 and associated stainless steel nuts 74.

The pair of boom end section assemblies 34 of the boom 24 each further comprises a pair of pin spring locks 76. The pair of pin spring locks 76 of the pair of boom end section assemblies 34 of the boom 24, respectively, extend in inboard ends 78 of the pair of boom end section assemblies 34 of the boom 24, respectively, and selectively engage with the ends 52 of the mast to boom driven element boom center section 32 of the boom 24, respectively, so as to be telescopic therewith and allow the boom 24 to be length adjustable.

E. The Specific Configuration of the Pair of Yagi Reflectors/Directors 36 of the Boom 24.

Figure 6A:
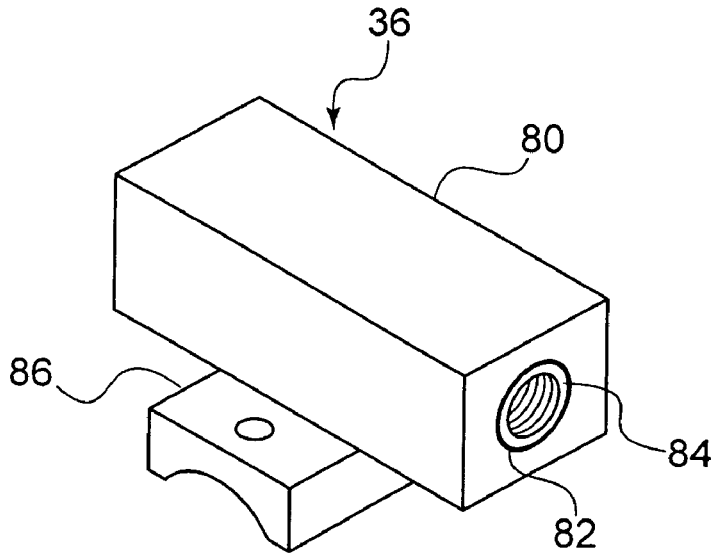
FIG. 6A is an enlarged diagrammatic perspective view of the Yagi reflector/director of the portable Yagi antenna kit of the embodiments of the present invention identified by ARROW 6A in FIG. 5A.
Figure 6B:
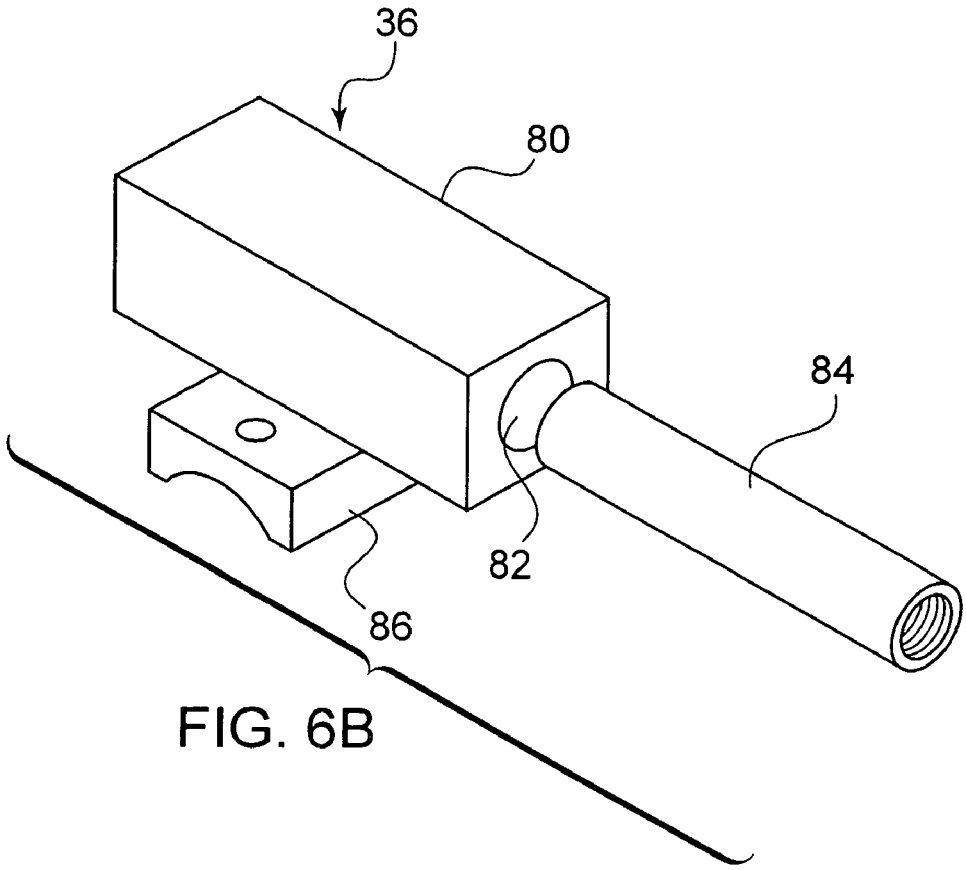
FIG. 6B is an exploded diagrammatic perspective view of the Yagi reflector/director of the portable Yagi antenna kit of the embodiments of the present invention shown in FIG. 6A.

The specific configuration of the pair of Yagi reflectors/directors 36 of the boom 24 can best be seen in FIGS. 6A and 6B, which, are, respectively, an enlarged diagrammatic perspective view of the Yagi reflector/director of the portable Yagi antenna kit of the embodiments of the present invention identified by ARROW 6A in FIG. 5A, and an exploded diagrammatic perspective view of the Yagi reflector/director of the portable Yagi antenna kit of the embodiments of the present invention shown in FIG. 6A, and as such, will be discussed with reference thereto.

The pair of Yagi reflectors/directors 36 of the boom 24 each include a dipole end section 80. The dipole end section 80 of each Yagi reflector/director 36 of the boom 24 is block-like, has a through bore 82 extending therethrough generally collinearly with the reflector element 26 and the director element 30, respectively, and is made from DELRIN® that is a registered trademark of DuPont and is a family of acetal resins known for their dimensional stability, stiffness, and fatigue and corrosion resistance.

The pair of Yagi reflectors/directors 36 of the boom 24 each further include a Yagi reflector/director end section 84. The Yagi reflector/director end section 84 of each Yagi reflector/director 36 of the boom 24 is internally threaded and extends snugly in the through bore 82 of the dipole end section 80 of an associated Yagi reflector/director 36 of the boom 24, and is made from brass.

The pair of Yagi reflectors/directors 36 of the boom 24 each further include a bracket 86. The bracket 86 of each Yagi reflector/director 36 of the boom 24 depends orthogonally from the dipole end section 80 of an associated Yagi reflector/director 36 of the boom 24, and is affixed collinearly to the outboard end 54 of an associated boom end section assembly 34 of the boom 24, respectively.

F. The Specific Configuration of the Yagi Driven Element Center Section 38 of the Boom 24.

Figure 7A:
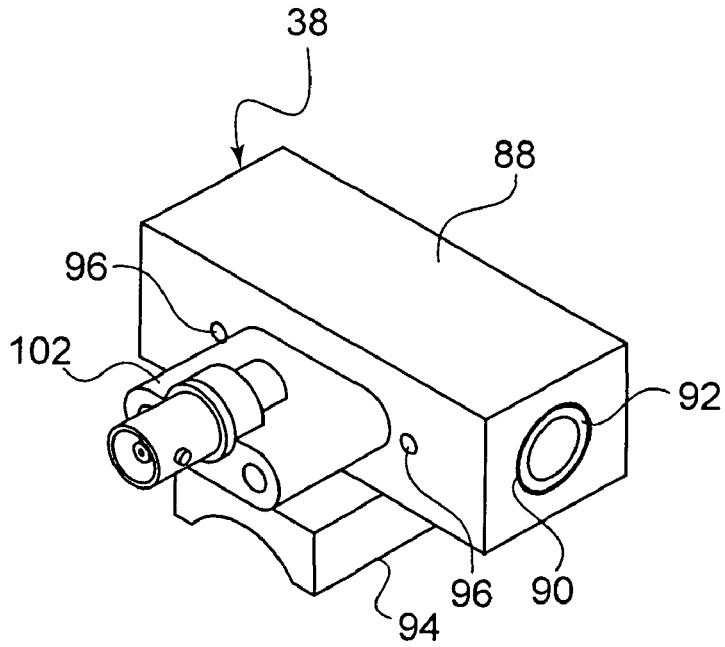
FIG. 7A is an enlarged diagrammatic perspective view of the Yagi driven element center section of the portable Yagi antenna kit of the embodiments of the present invention identified by ARROW 7A in FIG. 3.
Figure 7B:
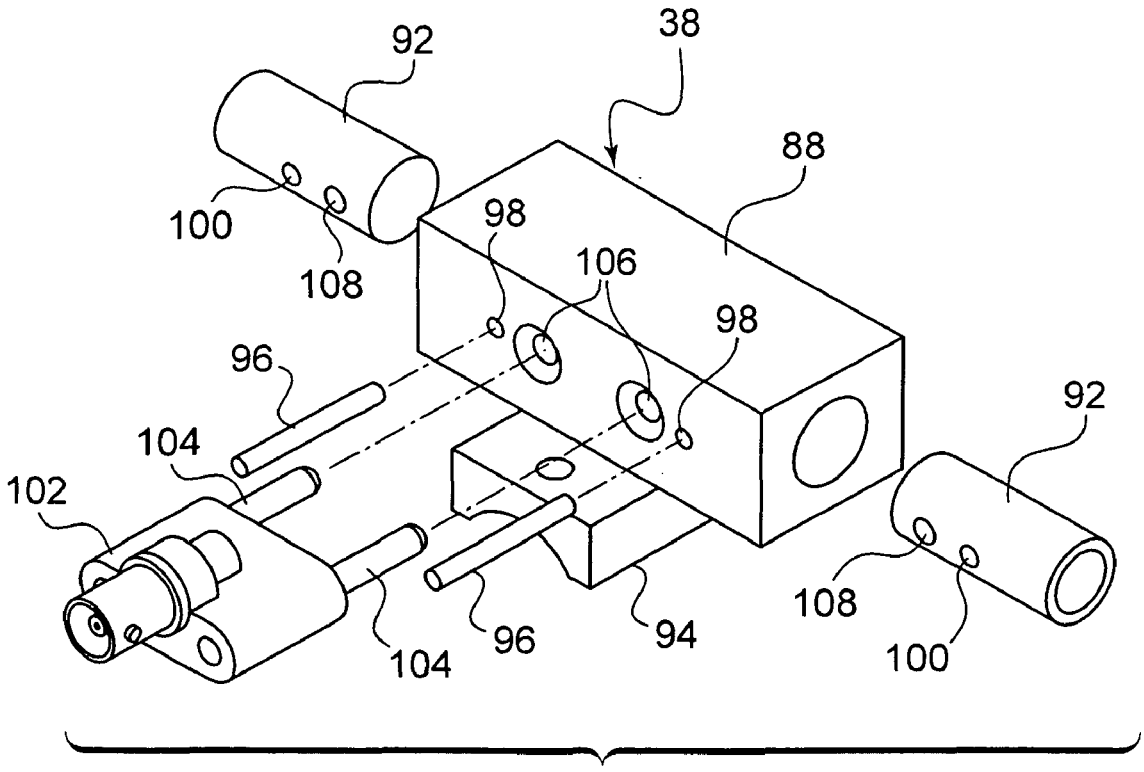
FIG. 7B is an exploded diagrammatic perspective view of the Yagi driven element center section of the portable Yagi antenna kit of the embodiments of the present invention shown in FIG. 7A.

The specific configuration of the Yagi driven element center section 38 of the boom 24 can best be seen in FIGS. 7A and 7B, which, are, respectively, an enlarged diagrammatic perspective view of the Yagi driven element center section of the portable Yagi antenna kit of the embodiments of the present invention identified by ARROW 7A in FIG. 3, and an exploded diagrammatic perspective view of the Yagi driven element center section of the portable Yagi antenna kit of the embodiments of the present invention shown in FIG. 7A, and as such, will be discussed with reference thereto.

The Yagi driven element center section 38 of the boom 24 includes a dipole center section 88. The dipole center section 88 of the Yagi driven element center section 38 of the boom 24 is block-like, has a through bore 90 extending therethrough generally collinearly with the driven element 28, and is made from DELRIN® that is a registered trademark of DuPont and is a family of acetal resins known for their dimensional stability, stiffness, and fatigue and corrosion resistance.

The Yagi driven element center section 38 of the boom 24 further includes a pair of Yagi driven element center sections 92. The pair of Yagi driven element center sections 92 of the Yagi driven element center section 38 of the boom 24 are internally threaded and extend snugly in the through bore 90 in the dipole center section 88 of the Yagi driven element center section 38 of the boom 24, and are made from brass.

The Yagi driven element center section 38 of the boom 24 further includes a bracket 94. The bracket 94 of the Yagi driven element center section 38 of the boom 24 depends orthogonally from the dipole-center section 88 of the Yagi driven element center section 38 of the boom 24, and is affixed collinearly and generally centrally to the mast to boom driven element boom center section 32 of the boom 24.

The Yagi driven element center section 38 of the boom 24 further includes a pair of pins 96. The pair of pins of the Yagi driven element center section 38 of the boom 24 extend in a first pair of bores 98 in the dipole center section 88 of the Yagi driven element center section 38 of the boom 24 and into a first bore 100 in each of the pair of Yagi driven element center sections 92 of the Yagi driven element center section 38 of the boom 24, respectively, and are made of stainless steel.

The Yagi driven element center section 38 of the boom 24 further includes a double banana plug 102. The double banana plug 102 of the Yagi driven element center section 38 of the boom 24 has a pair of pins 104. The pair of pins 104 of the double banana plug 102 of the Yagi driven element center section 38 of the boom 24 extend in a second pair of bores 106 in the dipole center section 88 of the Yagi driven element center section 38 of the boom 24 and into a second bore 108 in each of the pair of Yagi driven element center sections 92 of the Yagi driven element center section 38 of the boom 24, respectively.

G. The Specific Configuration of the Pair of Antenna Sections 40 of Each of the Reflector Element 26, the Driven Element 28, and the Director Element 30.

Figures 8A, 8B, 8C, 8D:
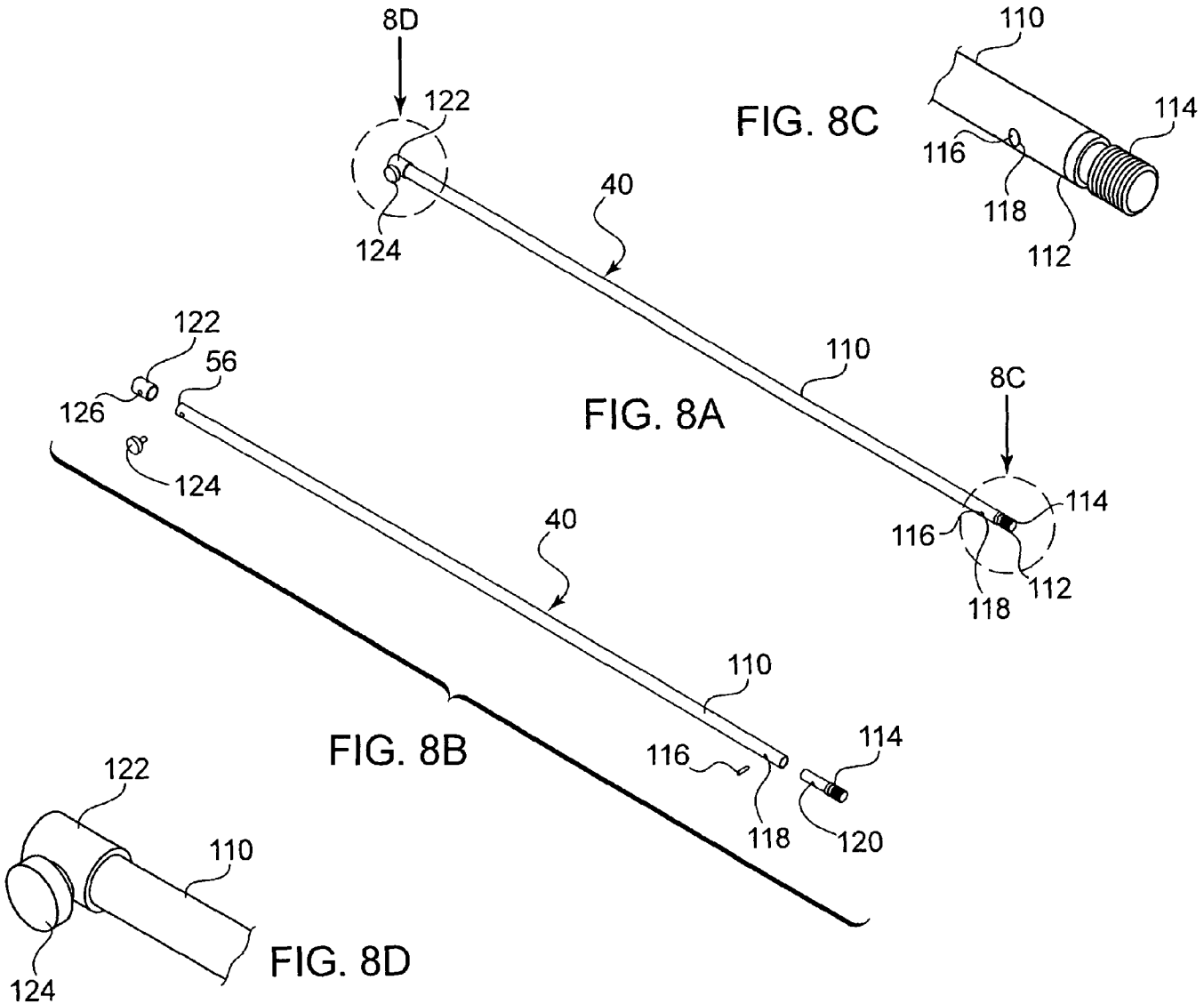
FIG. 8A is an enlarged diagrammatic perspective view of an antenna section of the portable Yagi antenna kit of the embodiments of the present invention identified by ARROW 8A in FIG. 3.
FIG. 8B is an exploded diagrammatic perspective view of the antenna section of the portable Yagi antenna kit of the embodiments of the present invention shown in FIG. 8A.
FIG. 8C is an enlarged diagrammatic perspective view of the area generally enclosed by the dotted curve identified by ARROW 8C in FIG. 8A of the brass threaded insert of the antenna section of the portable Yagi antenna kit of the embodiments of the present invention.
FIG. 8D is an enlarged diagrammatic perspective view of the area generally enclosed by the dotted curve identified by ARROW 8D in FIG. 8A of the thumb nut collar of the antenna section of the portable Yagi antenna kit of the embodiments of the present invention.

The specific configuration of the pair of antenna sections 40 of each of the reflector element 26, the driven element 28, and the director element 30 can best be seen in FIGS. 8A, 8B, 8C, and 8D, which are, respectively, an enlarged diagrammatic perspective view of an antenna section of the portable Yagi antenna kit of the embodiments of the present invention identified by ARROW 8A in FIG. 3, an exploded diagrammatic perspective view of the antenna section of the portable Yagi antenna kit of the embodiments of the present invention shown in FIG. 8A, an enlarged diagrammatic perspective view of the area generally enclosed by the dotted curve identified by ARROW 8C in FIG. 8A of the brass threaded insert of the antenna section of the portable Yagi antenna kit of the embodiments of the present invention, and an enlarged diagrammatic perspective view of the area generally enclosed by the dotted curve identified by ARROW 8D in FIG. 8A of the thumb nut collar of the antenna section of the portable Yagi antenna kit of the embodiments of the present invention, and as such, will be discussed with reference thereto.

Each antenna section 40 includes a tube 110. The tube 110 of each antenna section 40 has the outboard end 56 thereof, respectively, and an inboard end 112, and is made from an alloy.

Each antenna section 40 further includes a threaded insert 114. The threaded insert 114 of each antenna section 40 extends into the inboard end 112 of an associated antenna section 40, threads into both sides of the Yagi reflector/director end section 84 of each Yagi reflector/director of the pair of Yagi reflectors/directors 36 of the boom 24, respectively, threads into each of the pair of Yagi driven element center sections 92 of the Yagi driven element center section 38 of the boom 24, respectively, and is made from brass.

The threaded insert 114 of each antenna section 40 is maintained in the inboard end 112 of an associated antenna section 40 by a roll pin 116. The roll pin 116 in the inboard end 112 of an associated antenna section 40 passes laterally through a bore 118 in the inboard end 112 of an associated antenna section 40, and a bore 120 in the threaded insert 114 of the associated antenna section 40, and is made from stainless steel.

Each antenna section 40 further includes a collar 122. The collar 122 of each antenna section 40 extends over the outboard end 56 of an associated antenna section 40, and is made from aluminum.

Each antenna section 40 further includes a thumb screw 124. The thumb screw 124 of each antenna section 40 threads into a bore 126 in the collar 122 of an associated antenna section 40.

H. The Specific Configuration of the Pair of Another Antenna Sections 42 of Each of the Reflector Element 26, the Driven Element 28, and the Director Element 30.

Figures 9A, 9B, 9C:
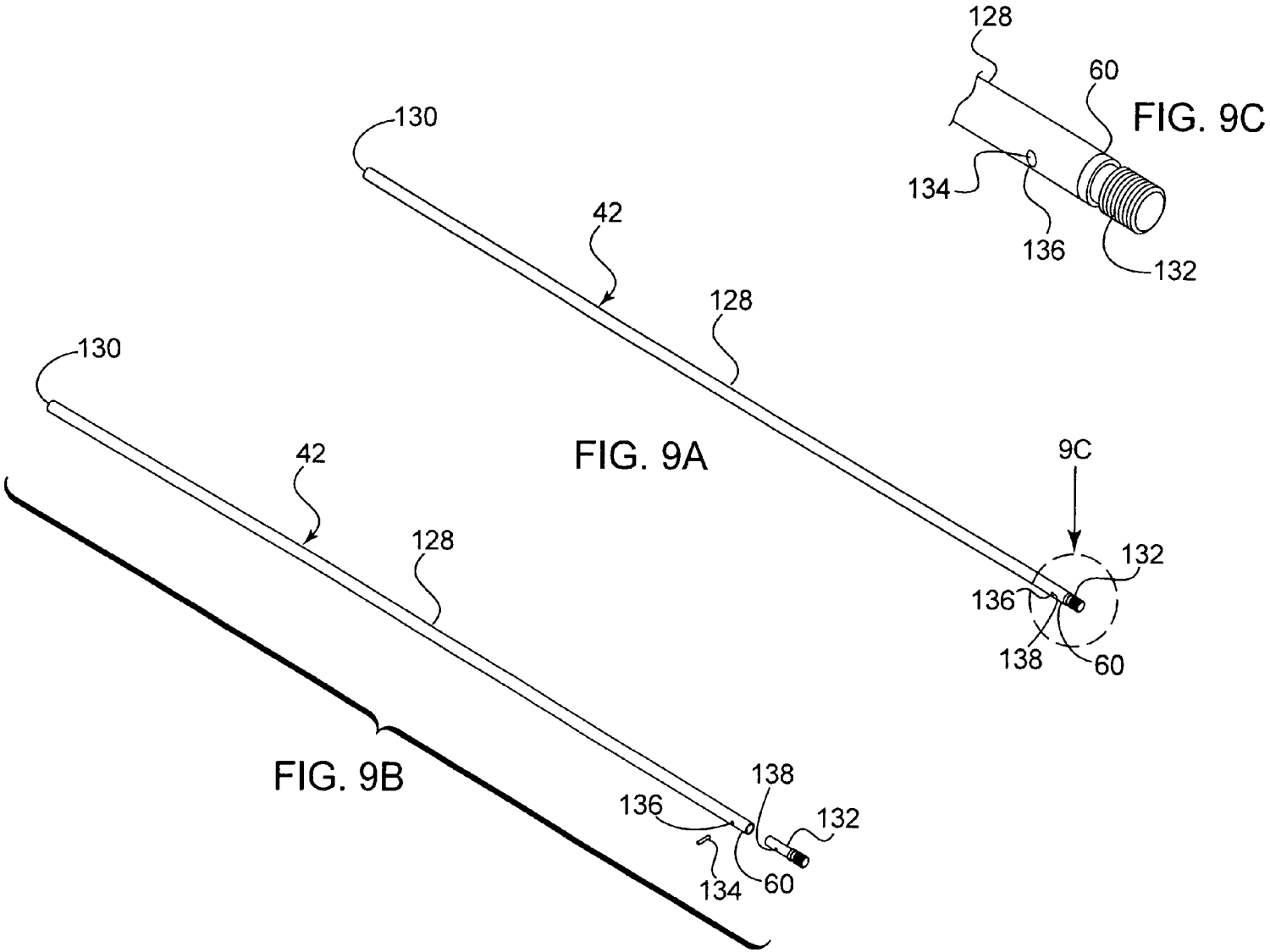
FIG. 9A is an enlarged diagrammatic perspective view of another antenna section of the portable Yagi antenna kit of the embodiments of the present invention identified by ARROW 9A in FIG. 3.
FIG. 9B is an exploded diagrammatic perspective view of the another antenna section of the portable Yagi antenna kit of the embodiments of the present invention shown in FIG. 9A.
FIG. 9C is an enlarged diagrammatic perspective view of the area generally enclosed by the dotted curve identified by ARROW 9C in FIG. 9A of the brass threaded insert of the another antenna section of the portable Yagi antenna kit of the embodiments of the present invention.

The specific configuration of the pair of another antenna sections 42 of each of the reflector element 26, the driven element 28, and the director element 30 can best be seen in FIGS. 9A, 9B, and 9C, which are, respectively, an enlarged diagrammatic perspective view of another antenna section of the portable Yagi antenna kit of the embodiments of the present invention identified by ARROW 9A in FIG. 3, an exploded diagrammatic perspective view of the another antenna section of the portable Yagi antenna kit of the embodiments of the present invention shown in FIG. 8A, and an enlarged diagrammatic perspective view of the area generally enclosed by the dotted curve identified by ARROW 9C in FIG. 9A of the brass threaded insert of the another antenna section of the portable Yagi antenna kit of the embodiments of the present invention, and as such, will be discussed with reference thereto.

Each another antenna section 42 includes a tube 128. The tube 128 of each another antenna section 40 has the outboard end 60 of the another pair of antenna sections 42, an inboard end 130, and is made from an alloy.

Each another antenna section 42 further includes a threaded insert 132. The threaded insert 132 of each another antenna section 42 extends into the outboard end 60 of an associated another antenna section 42, and is made from brass.

The threaded insert 132 of each another antenna section 42 is maintained in the outboard end 60 of an associated another antenna section 42 by a roll pin 134. The roll pin 134 in the outboard end 60 of an associated another antenna section 42 passes laterally through a bore 136 in the out board end 60 of an associated another antenna section 42 and a bore 138 in the threaded insert 132 of the associated another antenna section 42, and is made from stainless steel.

The inboard end 130 of the tube 128 of each another antenna section 42 telescopes into the collar 122 of an associated antenna section 40.

I. The Specific Configuration of the Pair of Wound Coils 44 of Each of the Reflector Element 26, the Driven Element 28, and the Director Element 30.

Figure 10A:
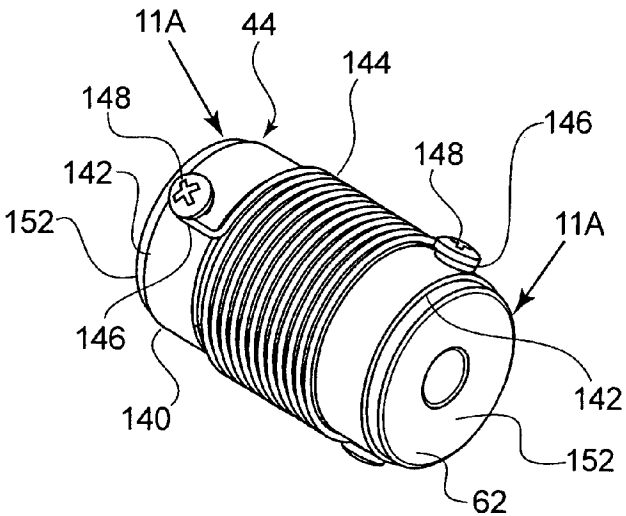
FIG. 10A is an enlarged diagrammatic perspective view of the wound coil of the portable Yagi antenna kit of the embodiments of the present invention identified by ARROW 10A in FIG. 3.
Figure 10B:
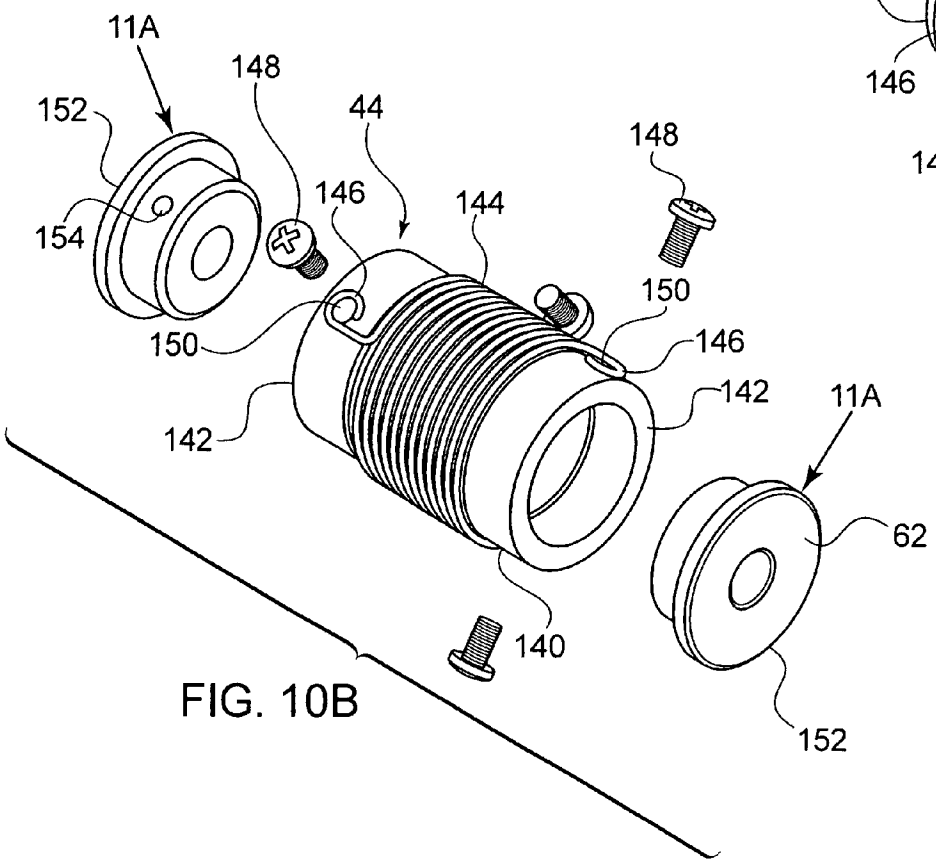
FIG. 10B is an exploded diagrammatic perspective view of the wound coil of the portable Yagi antenna kit of the embodiments of the present invention shown in FIG. 10A.

The specific configuration of the pair of wound coils 44 of each of the reflector element 26, the driven element 28, and the director element 30 can best be seen in FIGS. 10A and 10B, which are, respectively, an enlarged diagrammatic perspective view of the wound coil of the portable Yagi antenna kit of the embodiments of the present invention identified by ARROW 10A in FIG. 3, and an exploded diagrammatic perspective view of the wound coil of the portable Yagi antenna kit of the embodiments of the present invention shown in FIG. 10A, and as such, will be discussed with reference thereto.

Each wound coil 44 includes a Yagi coil tube 140. The Yagi coil tube 140 of each wound coil 44 has a pair of ends 142, and is made from PVC.

Each wound coil 44 includes a wire coil 144. The wire coil 144 of each wound coil 44 winds around the Yagi tube 140 of an associated wound coil 44, and terminates in a pair of looped ends 146.

The wire coil 144 of each wound coil 44 is maintained around the Yagi tube 140 of an associated wound coil 44 by a pair of screws 148. The pair of screws 148 of each wound coil 44 pass through the pair of looped ends 146 of the wire coil 144 of an associated wound coil 44, respectively, through a pair of bores 150 in the Yagi coil tube 140 of the associated wound coil 44, respectively, and are made from stainless steel.

Each wound coil 44 further includes a pair of coil end caps 152. The pair of coil end caps 152 of each wound coil 44 replaceably close the pair of ends 142 of the Yagi coil tube 140 of an associated wound coil 44, and are maintained thereat, by the pair of screws 148 of the associated wound coil 44 threading into diametrically-opposed and radially-oriented bores 154 in each coil end cap 152 of an associated wound coil 44, after passing through the bore 150 in the Yagi coil tube 140 of the associated wound coil 44, and are made from aluminum.

J. The Specific Configuration of the Pair of Coil End Caps 152 of Each Wound Coil 44 of the Pair of Wound Coils 44 of Each of the Reflector Element 26, the Driven Element 28, and the Director Element 30.

Figure 11B:
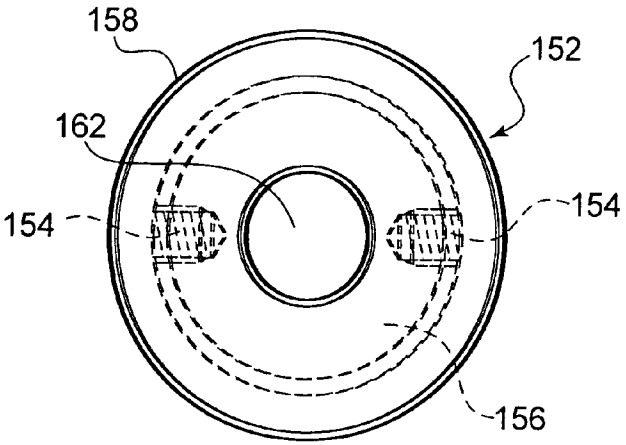
FIG. 11B is a diagrammatic top plan view taken generally in the direction of ARROW 11B in FIG. 11A.
Figure 11A:
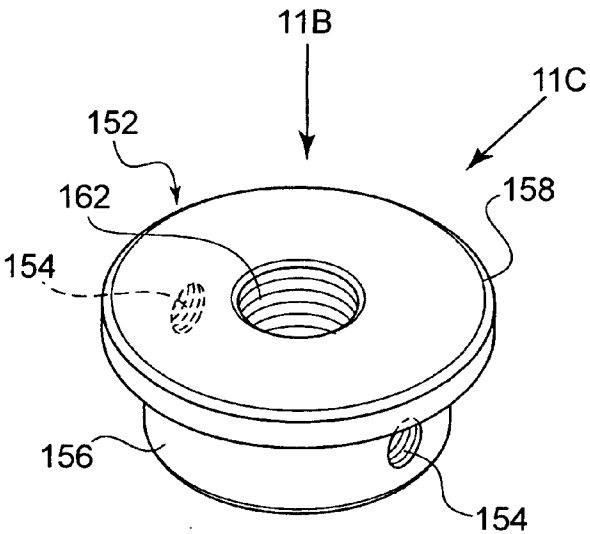
FIG. 11A is an enlarged diagrammatic perspective view of the coil end of the wound coil of the portable Yagi antenna kit of the embodiments of the present invention identified by ARROW 11A in FIGS. 10A and 10B.
Figure 11C:
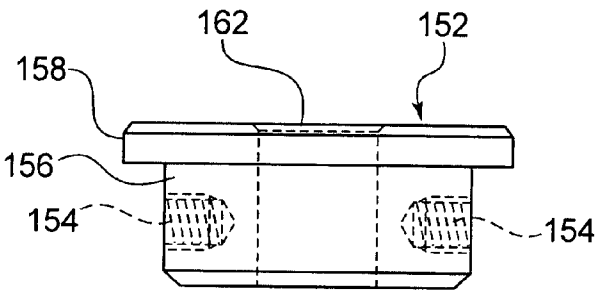
FIG. 11C is a diagrammatic elevational view taken generally in the direction of ARROW 11C in FIG. 11A.

The specific configuration of the pair of coil end caps 152 of each wound coil 44 of the pair of wound coils 44 of each of reflector element 26, driven element 28, and director element 30 can be seen in FIGS. 11A, 11B, and 11C, which are, respectively, an enlarged diagrammatic perspective view of the coil end of the wound coil of the portable Yagi antenna kit of the embodiments of the present invention identified by ARROW 11A in FIGS. 10A and 10B, a diagrammatic top plan view taken generally in the direction of ARROW 11B in FIG. 11A, and a diagrammatic elevational view taken generally in the direction of ARROW 11C in FIG. 11A, and as such, will be discussed with reference thereto.

Each coil end cap 152 of each wound coil 44 includes a plug 156. The plug 156 of each coil end cap 152 of each wound coil 44 is cylindrically shaped, has the diametrically-opposed and radially-oriented bores 154 therein, and plugs closed each end 142 of the Yagi coil tube 140 of an associated wound coil 44.

Each coil end cap 152 of each wound coil 44 further includes a flange 158. The flange 158 of each coil end cap 152 of each wound coil 44 is concentrically disposed on an outboard end 160 of, and is wider than, the plug 156 of an associated coil end cap 152 of an associated wound coil 44, and rests on the end 142 of the Yagi coil tube 140 of the associated wound coil 44.

Each coil end cap 152 of each wound coil 44 further includes a threaded through bore 162. The threaded through bore 162 in each coil cap 152 of each wound coil 44 extends centrally and axially through the flange 158 of an associated coil end cap 152 of an associated wound coil 44 and the plug 156 of the associated coil end cap 152 of the associated wound coil 44, and an inboard end cap 152 of each wound coil 44 threadably receives the out board end 60 of an associated another antenna section 42, and an outboard end cap 152 of the associated wound coil 44 threadably receives the still another antenna section 48.

K. The Specific Configuration of the Pair of Couplings 46 of Each of the Reflector Element 26, the Driven Element 28, and the Director Element 30, Respectively.

Figure 12A:
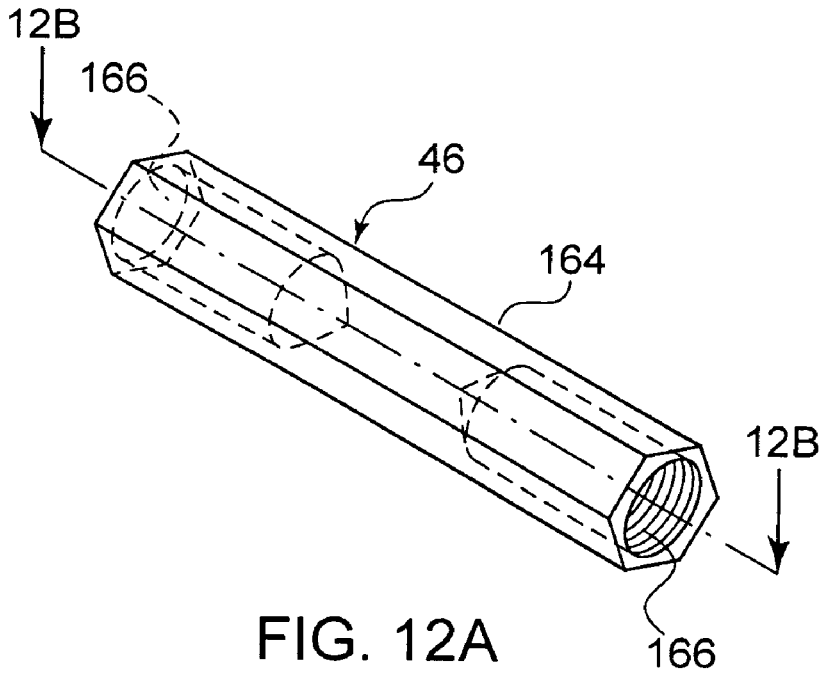
FIG. 12A is an enlarged diagrammatic perspective view of the coupling of the portable Yagi antenna kit of the embodiments of the present invention identified by ARROW 12A in FIG. 3.
Figure 12B:
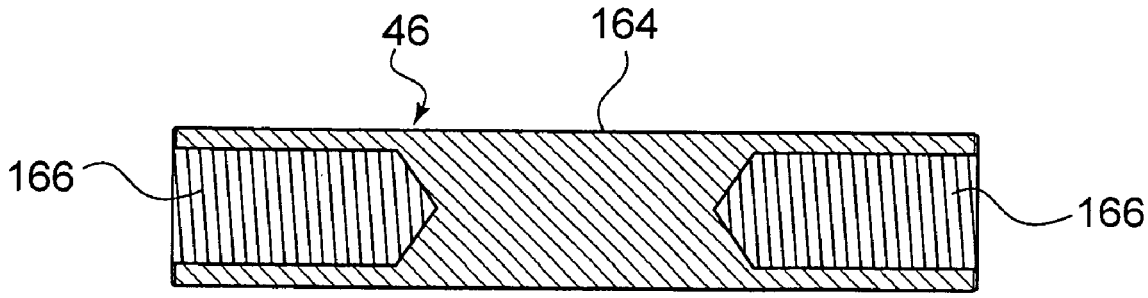
FIG. 12B is a diagrammatic cross sectional view taken along LINE 12B-12B in FIG. 12A.

The specific configuration of the pair of couplings 46 of each of the reflector element 26, the driven element 28, and the director element 30, respectively, can best be seen in FIGS. 12A and 12B, which are, respectively, an enlarged diagrammatic perspective view of the coupling of the portable Yagi antenna kit of the embodiments of the present invention identified by ARROW 12A in FIG. 3, and a diagrammatic cross sectional view taken along LINE 12B-12B in FIG. 12A, and as such, will be discussed with reference thereto.

Each coupling 46 includes a sleeve 164. The sleeve 164 of each coupling 46 is hexagonally shaped in cross section, and has a pair of threaded bores 166 extending axially therethrough terminating in the outboard end 64 of an associated coupling 46 and an inboard end 168 of the associated coupling 46, respectively.

The inboard end 168 of each coupling 46 threadably receives the out board end 60 of an associated another antenna section 42, and the outboard end 64 of the associated coupling 46 threadably receives the still another antenna section 48.

L. The Specific Configuration of the Pair of Still Another Antenna Sections 48 of Each of the Reflector Element 26, the Driven Element 28, and the Director Element 30.

Figures 13A, 13B, 13C, 13D:
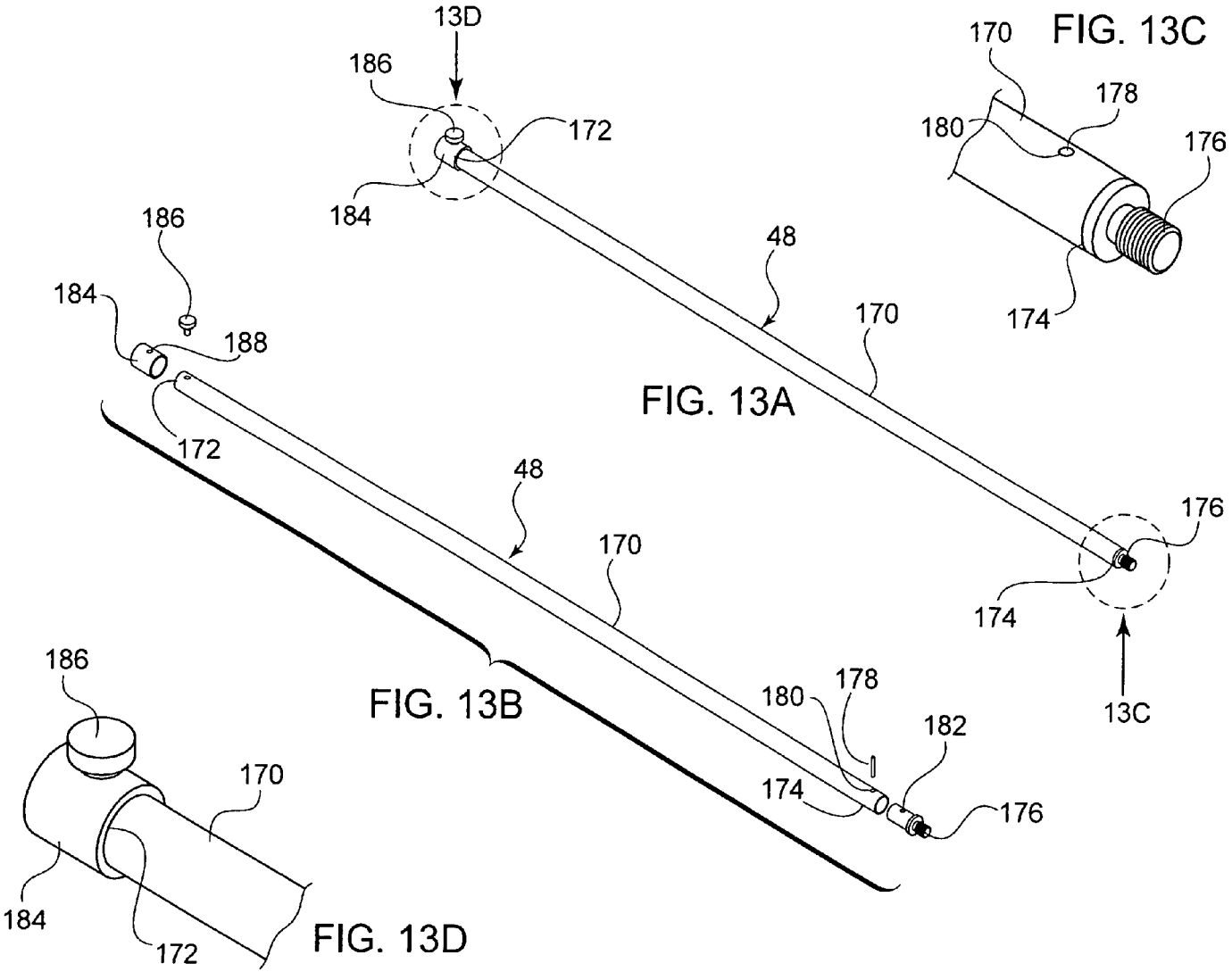
FIG. 13A is an enlarged diagrammatic perspective view of still another antenna section of the portable Yagi antenna kit of the embodiments of the present invention identified by ARROW 13A in FIG. 3.
FIG. 13B is an exploded diagrammatic perspective view of the still another antenna section of the portable Yagi antenna kit of the embodiments of the present invention shown in FIG. 13A.
FIG. 13C is an enlarged diagrammatic perspective view of the area generally enclosed by the dotted curve identified by ARROW 13C in FIG. 13A of the brass threaded insert of the still another antenna section of the portable Yagi antenna kit of the embodiments of the present invention.
FIG. 13D is an enlarged diagrammatic perspective view of the area generally enclosed by the dotted curve identified by ARROW 13D in FIG. 13A of the thumb nut collar of the still another antenna section of the portable Yagi antenna kit of the embodiments of the present invention.

The specific configuration of the pair of still another antenna sections 48 of each of the reflector element 26, the driven element 28, and the director element 30 can best be seen in FIGS. 13A, 13B, 13C, and 13D, which are, respectively, an enlarged diagrammatic perspective view of a still another antenna section of the portable Yagi antenna kit of the embodiments of the present invention identified by ARROW 13A in FIG. 3, an exploded diagrammatic perspective view of the still another antenna section of the portable Yagi antenna kit of the embodiments of the present invention shown in FIG. 13A, an enlarged diagrammatic perspective view of the area generally enclosed by the dotted curve identified by ARROW 13C in FIG. 13A of the brass threaded insert of the still another antenna section of the portable Yagi antenna kit of the embodiments of the present invention, and an enlarged diagrammatic perspective view of the area generally enclosed by the dotted curve identified by ARROW 13D in FIG. 13A of the thumb nut collar of the still another antenna section of the portable Yagi antenna kit of the embodiments of the present invention, and as such, will be discussed with reference thereto.

Each still another antenna section 48 includes a tube 170. The tube 170 of each still another antenna section 48 has an outboard end 172 and an inboard end 174, and is made from an alloy.

Each still another antenna section 48 further includes a threaded insert 176. The threaded insert 176 of each still another antenna section 48 extends into the inboard end 174 of an associated still another antenna section 48, threads into one of the outboard end 62 of the pair of wound coils 44 and the outboard end 64 of the pair of couplings 46, and is made from brass.

The threaded insert 176 of each still another antenna section 48 is maintained in the inboard end 174 of an associated still another antenna section 48 by a roll pin 178. The roll pin 178 in the inboard end 174 of an associated still another antenna section 48 passes laterally through a bore 180 in the inboard end 174 of an associated still another antenna section 48, and a bore 182 in the threaded insert 176 of the associated still another antenna section 48, and is made from stainless steel.

Each still another antenna section 48 further includes a collar 184. The collar 184 of each still another antenna section 48 extends over the outboard end 172 of an associated still another antenna section 48, and is made from aluminum.

Each still another antenna section 48 further includes a thumb screw 186. The thumb screw 186 of each still another antenna section 48 threads into a bore 188 in the collar 184 of an associated still another antenna section 48.

M. The Specific Configuration of the Mast to Boom Assembly 50 of the Boom 24.

Figure 14A:
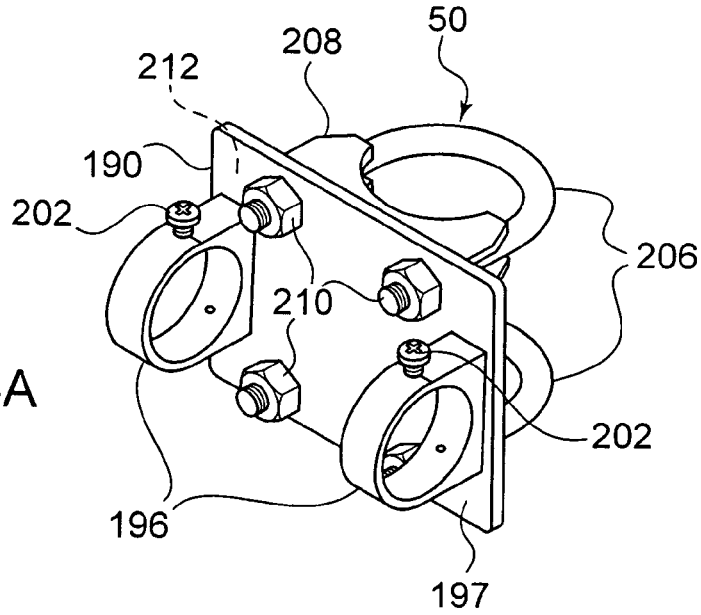
FIG. 14A is an enlarged diagrammatic perspective view of the mast to boom assembly of the portable Yagi antenna kit of the embodiments of the present invention identified by ARROW 14A in FIG. 3.
Figure 14B:
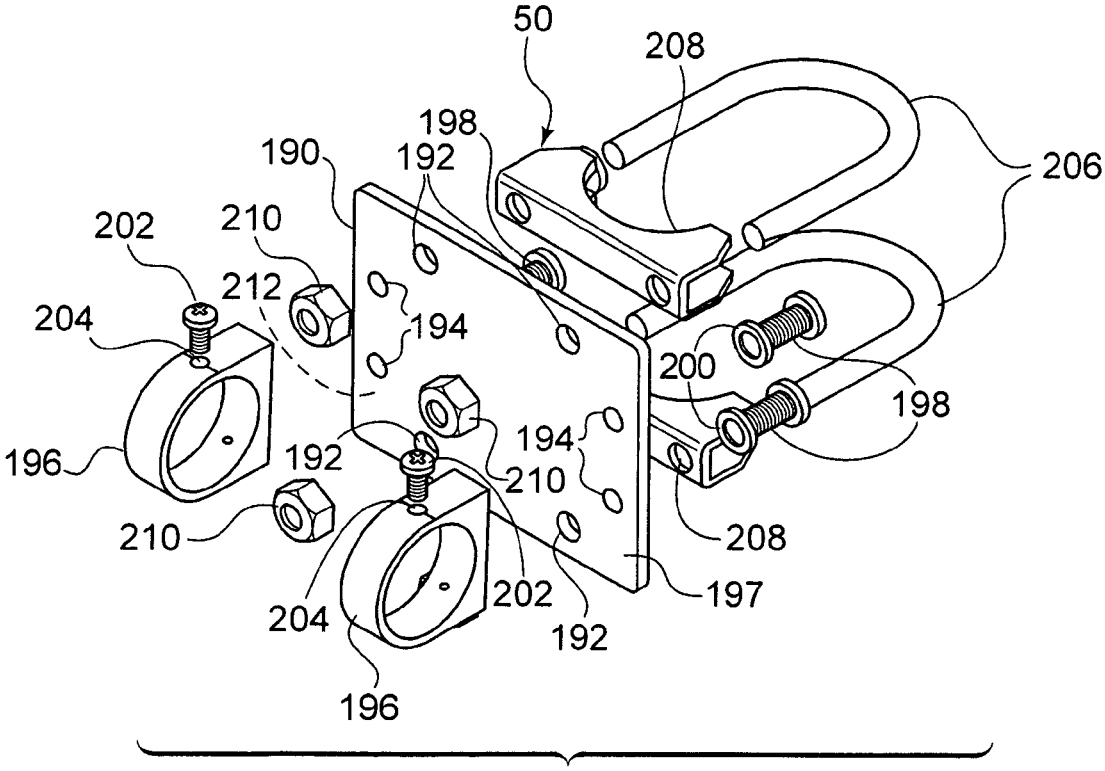
FIG. 14B is an exploded diagrammatic perspective view of the mast to boom assembly of the portable Yagi antenna kit of the embodiments of the present invention shown in FIG. 14A.

The specific configuration of the mast to boom assembly 50 of the boom 24 can best be seen in FIGS. 14A and 14B, which are, respectively, an enlarged diagrammatic perspective view of the mast to boom assembly of the portable Yagi antenna kit of the embodiments of the present invention identified by ARROW 14A in FIG. 3, and an exploded diagrammatic perspective view of the mast to boom assembly of the portable Yagi antenna kit of the embodiments of the present invention shown in FIG. 14A, and as such, will be discussed with reference thereto.

The mast to boom assembly 50 of the boom 24 includes a boom mounting plate 190. The boom mounting plate 190 of the mast to boom assembly 50 of the boom 24 is made from aluminum, and has two pair of primary through bores 192 and two pair of secondary through bores 194.

The mast to boom assembly 50 of the boom 24 further includes a pair of boom clamps 196. The pair of boom clamps 196 of the mast to boom assembly 50 of the boom 24 receive the boom center section tube 68 of the mast to boom driven element boom center section 32 of the boom 24 and are maintained against a boom facing side 197 of the boom mounting plate 190 of the mast to boom assembly 50 of the boom 24 by two pair of screws 198 that pass through two pair of washers 200, through the two pair of secondary through bores 194 in the boom mounting plate 190 of the mast to boom assembly 50 of the boom 24, and threadably into the pair of boom clamps 196 of the mast to boom assembly 50 of the boom 24.

The boom center section tube 68 of the mast to boom driven element boom center section 32 of the boom 24 is maintained in the pair of boom clamps 196 of the mast to boom assembly 50 of the boom 24 by a pair of clamp screws 202 that thread through through bores 204 in the pair of boom clamps 196 of the mast to boom assembly 50 of the boom 24, respectively, and bear against the boom center section tube 68 of the mast to boom driven element boom center section 32 of the boom 24.

The two pair of screws 198 of the mast to boom assembly 50 of the boom 24, the two pair of washers 200 of the mast to boom assembly 50 of the boom 24, and the pair of clamp screws 202 of the mast to boom assembly 50 of the boom 24 are made from stainless steel.

The mast to boom assembly 50 of the boom 24 further includes a pair of U-bolts 206, a pair of clamp bases 208, and two pair of nuts 210.

The pair of U-bolts 206 of the mast to boom assembly 50 of the boom 24 receive the pair of clamp bases 208 of the mast to boom assembly 50 of the boom 24, respectively, pass through the two pair of primary through bores 192 in the boom mounting plate 190 of the mast to boom assembly 50 of the boom 24, respectively, from a mast facing side 212 of the boom mounting plate 190 of the mast to boom assembly 50 of the boom 24, threadably engage in the two pair of nuts 210 of the mast to boom assembly 50 of the boom 24, respectively, and are for receiving the mast 22 for attaching the assembled Yogi antenna kit 20 to the mast 22.

N. The Specific Configuration of the Tuner 31.

Figure 15:
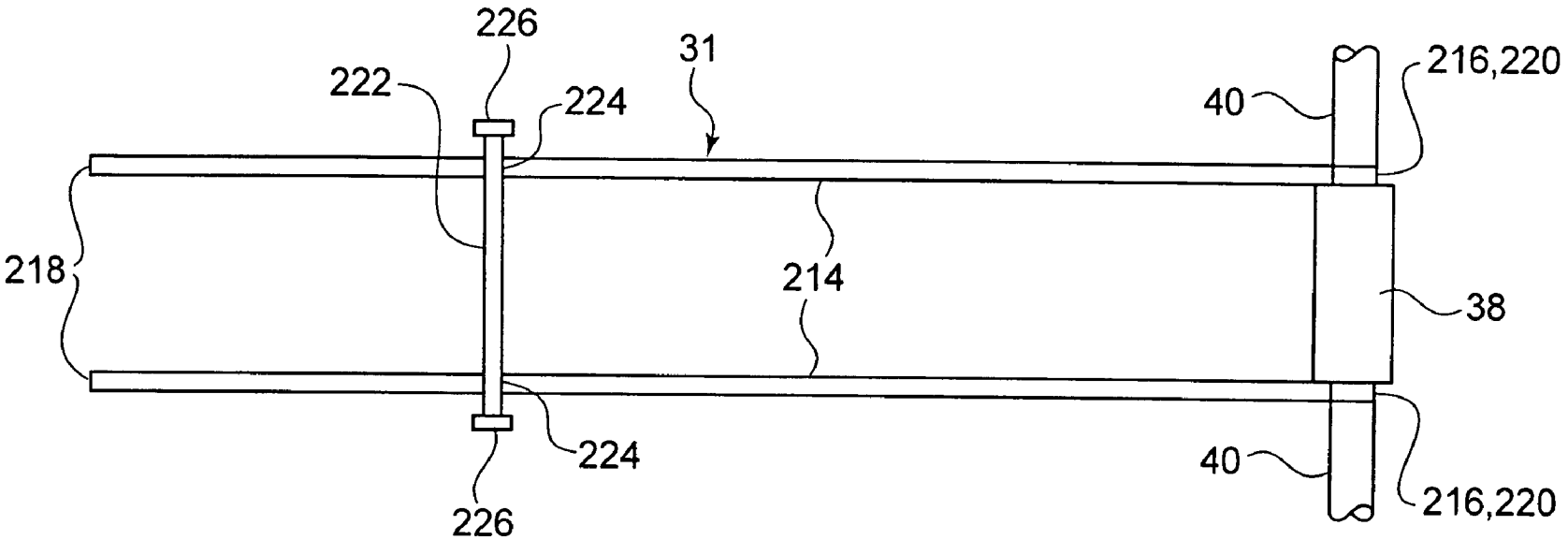
FIG. 15 is an enlarged diagrammatic bottom plan view of the tuner assembly of the portable Yagi antenna kit of the embodiments of the present invention identified by ARROW 15 in FIG. 3.

The specific configuration of the tuner 31 can best be seen in FIG. 15, which is an enlarged diagrammatic bottom plan view of the tuner assembly of the portable Yagi antenna kit of the embodiments of the present invention identified by ARROW 15 in FIG. 3, and as such, will be discussed with reference thereto.

The tuner 31 includes a pair of hairpin rods 214. Each of the pair of hairpin rods 214 of the tuner 31 is a ⅛" brass rod that has an inboard end 216 and an outboard end 218.

The inboard end 216 of each of the pair of hairpin rods 214 of the tuner 31 is formed into a ring lug 220 that is ⅜" in diameter and receives the threaded insert 114 of an associated antenna section 40 as the threaded insert 114 of the associated antenna section 40 threads into each of the pair of Yagi driven element center sections 92 of the Yagi driven element center section 38 of the boom 24, respectively.

The tuner 31 further includes a shortening rod 222. The shortening rod 222 of the tuner 31 has a pair of through bores 224 that receive the outboard end 218 of each of the pair of hairpin rods 214 of the tuner 31, respectively, in such a manner so as to maintain the pair of hairpin rods 214 of the tuner 31 parallel to the mast to boom driven element boom center section 32 of the boom 24.

The shortening rod 222 of the tuner 31 further includes a pair of thumb wheels 226. The pair of thumb wheels 226 of the shortening rod 222 of the tuner 31 threadably engages against the pair of hairpin rods 214 of the tuner 31 to thereby maintain the shortening rod 222 of the tuner 31 on the pair of hairpin rods 214 of the tuner 31 at a position commensurate with the band chosen.

O. The Specific Configuration of the Pair of Long Terminal Antenna Sections 49 of Each of the Reflector Element 26, the Driven Element 28, and the Director Element 30, and the Pair of Short Terminal Antenna Sections 51 of Each of the Reflector Element 26, the Driven Element 28, and the Director Element 30.

As shown in FIG. 3, one of the pair of long terminal antenna sections 49 and the pair of short terminal antenna sections 51 extend from the pair of still another antenna sections 48, respectively, depending upon desired length due to available space.

P. The Carrying Case 228 and the Tape Measure 230.

Figure 16:
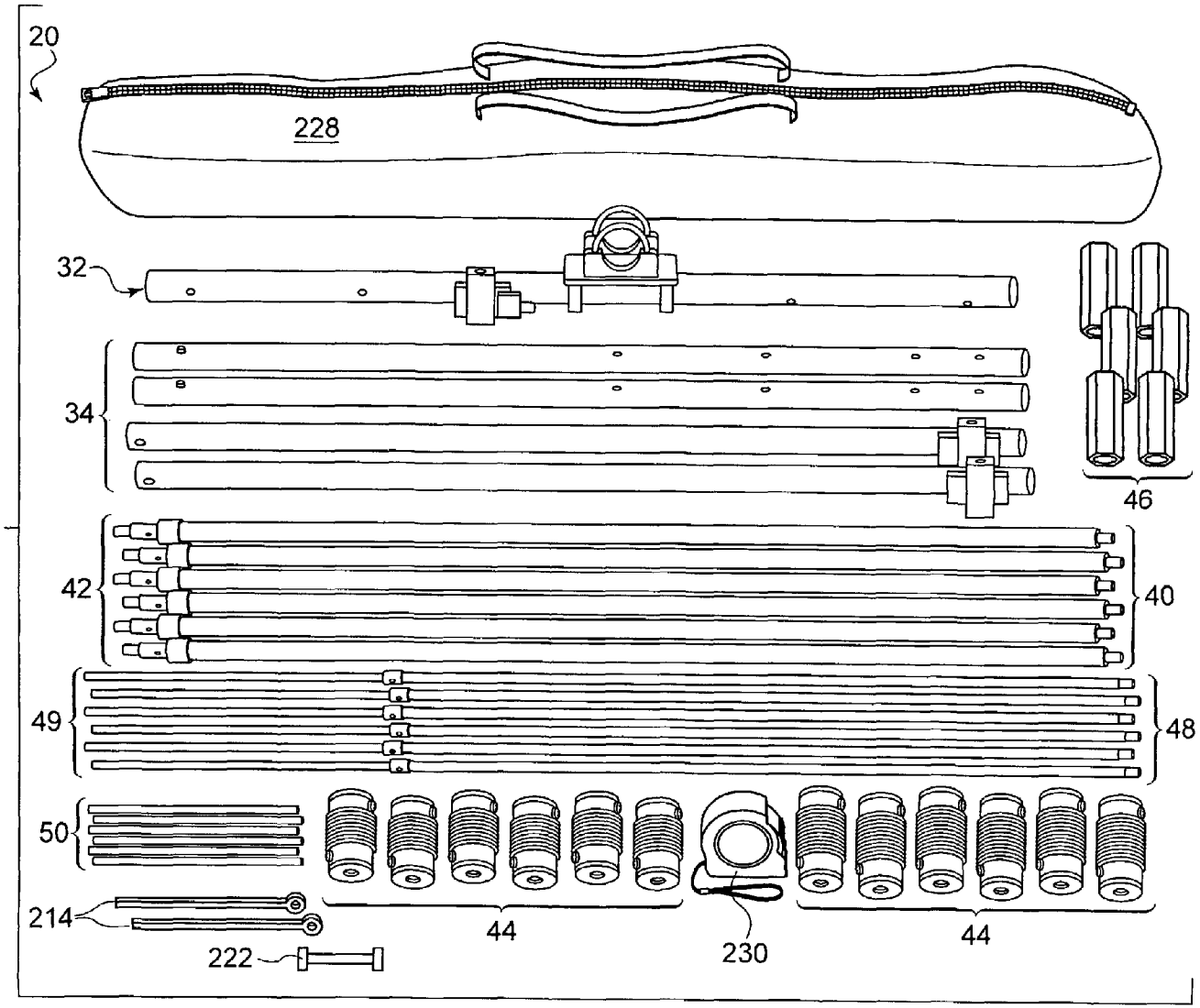
FIG. 16 is an exploded diagrammatic perspective view of the portable Yagi antenna kit of the embodiments of the present invention knocked down and ready for transport as a kit.
Figure 18:
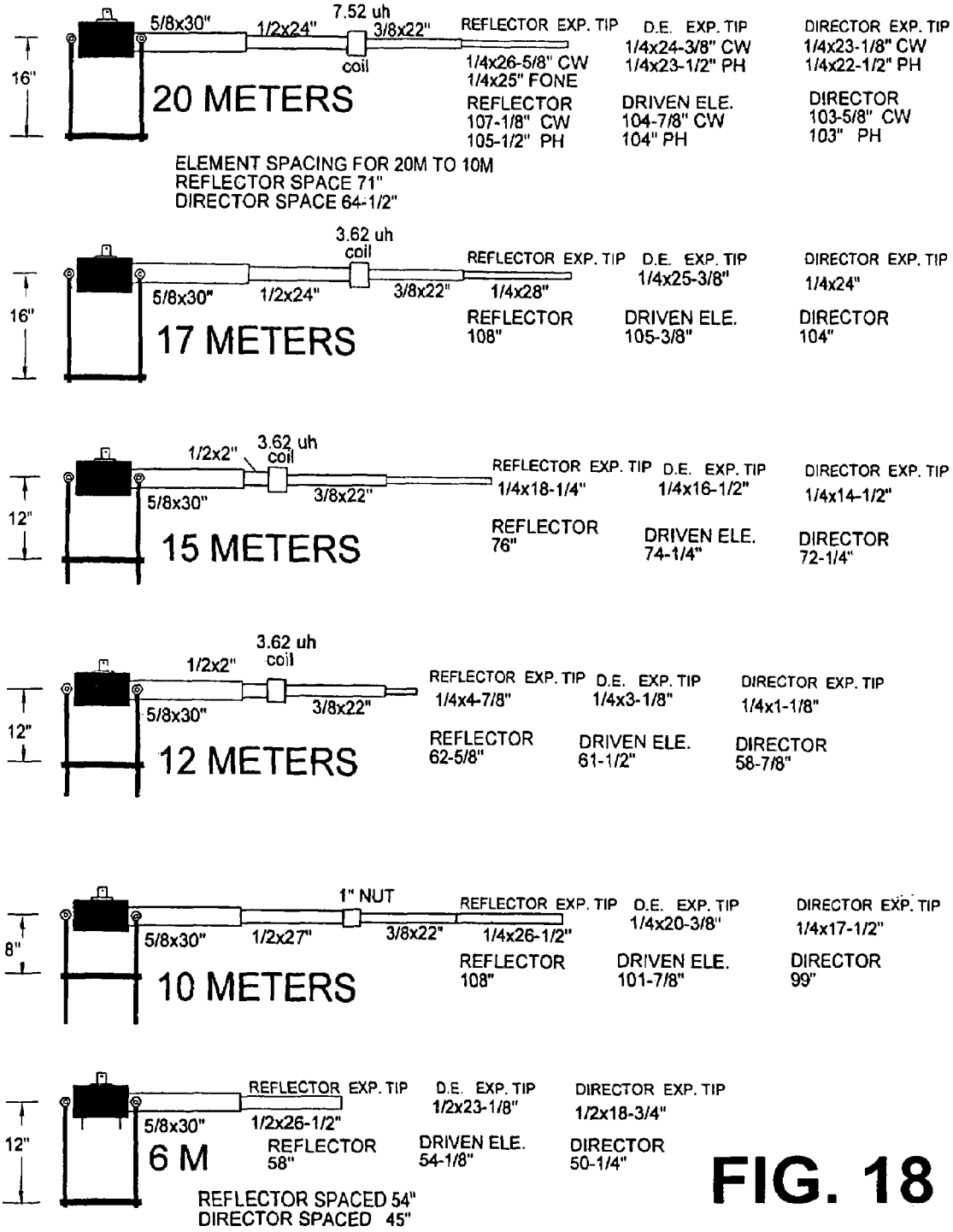
FIG. 18 is a YP3 Quick Assembly Guide.

As shown in FIG. 16, which is an exploded diagrammatic perspective view of the portable Yagi antenna kit of the embodiments of the present invention knocked down and ready for transport as a kit, the Yogi antenna kit 20 further comprises a carrying case 228 and a tape measure 230.

The carrying case 228 holds the mast to boom driven element boom center section 32 of the boom 24, the pair of boom end section assemblies 34 of the boom 24, the pair of antenna sections 40 of each of the reflector element 26, the driven element 28, and the director element 30, the pair of another antenna sections 42 of each of the reflector element 26, the driven element 28, and the director element 30, the pair of still another antenna sections 48 of each of the reflector element 26, the driven element 28, and the director element 30, the pair of wound coils 44 of each of the reflector element 26, the driven element 28, and the director element 30, the pair of couplings 46 of each of the reflector element 26, the driven element 28, and the director element 30, the tape measure 230, the pair of hairpin rods 214 of the tuner 31, the shortening rod 222 of the tuner 31, the pair of long terminal antenna sections 49 of each of the reflector element 26, the driven element 28, and the director element 30, and the pair of short terminal antenna sections 51 of each of the reflector element 26, the driven element 28, and the director element 30.

Q. The Method of Assembling the Portable Yagi Antenna Kit 20.

The method of assembling the portable Yagi antenna kit 20 can best be seen in FIGS. 17A-17L and 18, which are, respectively, a flow chart of the method of assembling the portable Yagi antenna kit 20, and a YP3 Quick Assembly Guide, and as such, will be discussed with reference thereto.

The method of assembling the portable Yagi antenna kit 20, comprises the steps of:

STEP 1: Chose a band to operate in prior to assembly.

STEP 2: Lay out the mast to boom driven element boom center section 32 of the boom 24 and the pair of boom end section assemblies 34 of the boom 24, utilizing FIG. 18 for dimensions.

STEP 3: Assemble the boom 24.

STEP 4: Lay out the pair of antenna sections 40 of each of the reflector element 26, the driven element 28, and the director element 30, the pair of another antenna sections 42 of each of the reflector element 26, the driven element 28, and the director element 30, the pair of still another antenna sections 48 of each of the reflector element 26, the driven element 28, and the director element 30, and the pair of long terminal antenna sections 49 of each of the reflector element 26, the driven element 28, and the director element 30 or the pair of short terminal antenna sections 51 of each of the reflector element 26, the driven element 28, and the director element 30, utilizing FIG. 18 for dimensions. The dimensions indicated on FIG. 18 can be engraved into the pair of antenna sections 40 of each of the reflector element 26, the driven element 28, and the director element 30, the pair of another antenna sections 42 of each of the reflector element 26, the driven element 28, and the director element 30, the pair of still another antenna sections 48 of each of the reflector element 26, the driven element 28, and the director element 30, the pair of long terminal antenna sections 49 of each of the reflector element 26, the driven element 28, and the director element 30, and the pair of short terminal antenna sections 51 of each of the reflector element 26, the driven element 28, and the director element 30.

STEP 5: Assemble the pair of antenna sections 40 of each of the reflector element 26, the driven element 28, and the director element 30, the pair of another antenna sections 42 of each of the reflector element 26, the driven element 28, and the director element 30, the pair of still another antenna sections 48 of each of the reflector element 26, the driven element 28, and the director element 30, and the pair of long terminal antenna sections 49 of each of the reflector element 26, the driven element 28, and the director element 30 or the pair of short terminal antenna sections 51 of each of the reflector element 26, the driven element 28, and the director element 30 together.

STEP 6: Determine if 2GM is being used.

STEP 7: Use only the pair of wound coils 44 of each of the reflector element 26, the driven element 28, and the director element 30, if answer to STEP 6 is yes.

STEP 8: Set the exposed length of the pair of antenna sections 40 of each of the reflector element 26, the driven element 28, and the director element 30, the pair of another antenna sections 42 of each of the reflector element 26, the driven element 28, and the director element 30, the pair of still another antenna sections 48 of each of the reflector element 26, the driven element 28, and the director element 30, and the pair of long terminal antenna sections 49 of each of the reflector element 26, the driven element 28, and the director element 30 or the pair of short terminal antenna sections 51 of each of the reflector element 26, the driven element 28, and the director element 30 using the tape measure 230.

STEP 9: Determine if a same band is going to be used over and over again.

STEP 10: Mark dimension with a permanent felt pen marker and note the band next to the marks to speed up reassembly at the next site, if answer to STEP 9 is yes.

STEP 11: Screw the reflector element 26 and the director element 30 into the pair of Yagi reflectors/directors 36 of the boom 24, respectively.

STEP 12: Screw the driven element 28 into the Yagi driven element center section 38 of the boom 24.

STEP 13: Ascertain that the reflector element 26 is placed at the correct spacing to the driven element 28.

STEP 14: Insert the threaded insert 114 of each antenna section 40 of the driven element 28 through the ring lug 220 of the pair of hairpin rods 214 of the tuner 31, respectively, and then screw the threaded insert 114 of each antenna section 40 of the driven element 28 into the pair of Yagi driven element center sections 92 of the Yagi driven element center section 38 of the boom 24, respectively.

STEP 15: Align the pair of hairpin rods 214 of the tuner 31 parallel with the boom 24.

STEP 16: Install the shortening rod 222 of the tuner 31 on the pair of hairpin rods 214 of the tuner 31.

STEP 17: Use the shortening rod 222 of the tuner 31 to set the pair of hairpin rods 214 of the tuner 31 to a proper length for band chosen.

STEP 18: Plug in the double banana plug 102 of the Yagi driven element center section 38 of the boom 24 to an BNC adapter.

STEP 19: Attach a feed line.

STEP 20: Mount the assembled Yagi antenna kit 20 on an appropriate mast 22 as high as possible.

STEP 21: Determine if the assembled Yagi antenna kit 20 is placed 15 to 20 feet above ground.

STEP 22: Ascertain that the best match is very close to center of the band or band segment chosen, if answer to STEP 21 is yes.

STEP 23: Make small adjustments to the pair of long terminal antenna sections 49 of each of the reflector element 26, the driven element 28, and the director element 30 or the pair of short terminal antenna sections 51 of each of the reflector element 26, the driven element 28, and the director element 30 to bring the match to the desired frequency.

STEP 24: Determine if large frequency shifts are required.

STEP 25: Find the frequency where the assembled Yagi antenna kit 20 is working properly, if answer to STEP 24 is yes.

STEP 26: Divide that frequency by the new frequency.

STEP 27: Measure half length.

STEP 28: Adjust each of the pair of long terminal antenna sections 49 of each of the reflector element 26, the driven element 28, and the director element 30 or the pair of short terminal antenna sections 51 of each of the reflector element 26, the driven element 28, and the director element 30 to achieve a new element half length of the reflector element 26, the driven element 28, and the director element 30.

STEP 29: Make small improvements in frequency and VSWR by adjusting the pair of long terminal antenna sections 49 or the pair of short terminal antenna sections 51 of the driven element 28 slightly.

R. The Impressions.

It will be understood that each of the elements described above or two or more together may also find a useful application in other types of constructions differing from the types described above.

While the embodiments of the present invention have been illustrated and described as embodied in a portable Yagi antenna kit for being knockdownable, and as such, being frequency/wavelength adjustable, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A portable Yagi antenna kit for being frequency/wavelength adjustable by virtue of being knockdownable, wherein said Yagi antenna is for mounting to a mast, said kit comprising:

a) a boom;

b) a reflector element;

c) a driven element; and d) a director element;

wherein said reflector element extends outwardly from said boom;

wherein said driven element extends outwardly from said boom;

wherein said director element extends outwardly from said boom; and wherein said boom, said reflector element, said driven element, and said director element are each knockdownable so as to be portable and form said kit, and as such, are length adjustable, and as such, are frequency/wavelength adjustable.

2. The kit of claim 1, wherein said boom comprises:

a) a mast to boom driven element boom center section;

b) a pair of boom end section assemblies;

c) a pair of Yagi reflectors/directors; and d) a Yagi driven element center element.

3. The kit if claim 2, wherein said reflector element, said driven element, and said director element each comprises:

a) a pair of antenna sections; and b) another pair of antenna sections.

4. The kit of claim 3, wherein said reflector element, said driven element, and said director element each comprises a pair of one of wound coils and couplings.

5. The kit of claim 4, wherein said reflector element, said driven element, and said director element each comprises a still another pair of antenna sections.

6. The kit of claim 5, wherein said boom comprises a mast to boom assembly.

7. The kit of claim 6, wherein said pair of boom end section assemblies of said boom extend telescopically from ends of said mast to boom driven element boom center section of said boom, respectively.

8. The kit of claim 7, wherein said pair of Yagi reflectors/directors of said boom are disposed on outboard ends of said pair of boom end section assemblies of said boom, respectively.

9. The kit of claim 8, wherein said Yagi driven element center element of said boom is disposed generally centrally on said mast to boom driven element boom center section of said boom.

10. The kit of claim 9, wherein said pair of antenna sections of each of said reflector element, said driven element, and said director element extend threadably from said pair of Yagi reflectors/directors of said boom and said Yagi driven element center element of said boom, respectively.

11. The kit of claim 10, wherein said another pair of antenna sections of each of said reflector element, said driven element, and said director element extend telescopically from outboard ends of said pair of antenna sections thereof.

12. The kit of claim 11, wherein said pair of wound coils extend threadably from outboard ends of said another pair of antenna sections of each of said reflector element, said driven element, and said director element, respectively.

13. The kit of claim 12, wherein said pair of couplings extend threadably from said outboard ends of said another pair of antenna sections of each of said reflector element, said driven element, and said director element, respectively.

14. The kit of claim 13, wherein said still another pair of antenna sections extend threadably from outboard ends of said pair of wound coils of each of said reflector element, said driven element, and said director element, respectively.

15. The kit of claim 14, wherein said still another pair of antenna sections extend threadably from outboard ends of said pair of couplings of each of said reflector element, said driven element, and said director element, respectively.

16. The kit of claim 15, wherein said mast to boom driven element boom center section of said boom comprises a boom center section tube; and wherein said boom center section tube of said mast to boom driven element boom center section of said boom has said ends of said mast to boom driven element boom center section of said boom.

17. The kit of claim 16, wherein said boom center section tube of said mast to boom driven element boom center section of said boom is made from aluminum.

18. The kit of claim 17, wherein said Yagi driven element center element of said boom is disposed generally centrally on said boom center section tube of said mast to boom driven element boom center section of said boom.

19. The kit of claim 18, wherein said mast to boom assembly of said boom is disposed adjacent to said Yagi driven element center element of said boom.

20. The kit of claim 19, wherein said pair of boom end section assemblies of said boom each comprises a boom end section tube; and wherein each boom end section tube of said boom has said outboard end of said pair of boom end section assemblies of said boom.

21. The kit of claim 20, wherein each boom end section tube of said boom is made from aluminum.

22. The kit of claim 21, wherein said pair of Yagi reflectors/directors of said boom are disposed on said pair of boom end section tubes of said boom, respectively, at said outboard end of said pair of boom end section assemblies of said boom, respectively.

23. The kit of claim 22, wherein said pair of Yagi reflectors/directors of said boom are disposed on said pair of boom end section tubes of said boom, respectively, at said outboard end of said pair of boom end section assemblies of said boom, respectively, by a pair of stainless steel screws and associated stainless steel nuts.

24. The kit of claim 23, wherein said pair of boom end section assemblies of said boom each comprises a pair of pin spring locks;

wherein said pair of pin spring locks of said pair of boom end section assemblies of said boom, respectively, extend in inboard ends of said pair of boom end section assemblies of said boom, respectively; and wherein said pair of pin spring locks selectively engage with said ends of said mast to boom driven element boom center section of said boom, respectively, so as to be telescopic therewith and allow said boom to be length adjustable.

25. The kit of claim 24, wherein said pair of Yagi reflectors/directors of said boom each include a dipole end section;

wherein said dipole end section of each Yagi reflector/director of said boom is block-like; and wherein said dipole end section of each Yagi reflector/director of said boom has a through bore extending therethrough generally collinearly with said reflector and said director, respectively.

26. The kit of claim 25, wherein said dipole end section of each Yagi reflector/director of said boom is made from a material from a family of acetal resins known for their dimensional stability, stiffness, and fatigue and corrosion resistance.

27. The kit of claim 26, wherein said pair of Yagi reflectors/directors of said boom each include a Yagi reflector/director end section;

wherein said Yagi reflector/director end section of each Yagi reflector/director of said boom is internally threaded; and wherein said Yagi reflector/director end section of each Yagi reflector/director of said boom extends snugly in said through bore of said dipole end section of an associated Yagi reflector/director of said boom.

28. The kit of claim 27, wherein said Yagi reflector/director end section of each Yagi reflector/director of said boom is made from brass.

29. The kit of claim 28, wherein said pair of Yagi reflectors/directors of said boom each include a bracket;

wherein said bracket of each Yagi reflector/director of said boom depends from said dipole end section of an associated Yagi reflector/director of said boom; and wherein said bracket of each Yagi reflector/director of said boom is affixed to and collinear with said outboard end of an associated boom end section assembly of said boom, respectively.

30. The kit of claim 29, wherein said Yagi driven element center section of said boom includes a dipole center section;

wherein said dipole center section of said Yagi driven element center section of said boom is block-like; and wherein said dipole center section of said Yagi driven element center section of said boom has a through bore extending therethrough generally collinearly with said driven element.

31. The kit of claim 30, wherein said dipole center section of said Yagi driven element center section of said boom is made from a material from a family of acetal resins known for their dimensional stability, stiffness, and fatigue and corrosion resistance.

32. The kit of claim 31, wherein said Yagi driven element center section of said boom includes a pair of Yagi driven element center sections; and wherein said pair of Yagi driven element center sections of said Yagi driven element center section of said boom is internally threaded and extend snugly in said through bore of said dipole center section of said Yagi driven element center section of said boom.

33. The kit of claim 32, wherein said pair of Yagi driven element center sections of said Yagi driven element center section of said boom are made from brass.

34. The kit of claim 33, wherein said Yagi driven element center section of said boom includes a bracket;

wherein said bracket of said Yagi driven element center section of said boom depends orthogonally from said dipole center section thereof said Yagi driven element center section of said boom; and wherein said bracket of said Yagi driven element center section of said boom is affixed collinearly and generally centrally to said mast to boom driven element boom center section of said boom.

35. The kit of claim 34, wherein said Yagi driven element center section of said boom includes a pair of pins; and wherein said pair of pins of said Yagi driven element center section of said boom extend in a first pair of bores in said dipole center section of said Yagi driven element center section of said boom and into a first bore in each of said pair of Yagi driven element center sections of said Yagi driven element center section of said boom, respectively.

36. The kit of claim 35, wherein said pair of pins of said Yagi driven element center section of said boom are made from stainless steel.

37. The kit of claim 36, wherein said Yagi driven element center section of said boom includes a double banana plug;

wherein said double banana plug of said Yagi driven element center section of said boom has a pair of pins; and wherein said pair of pins of said double banana plug of said Yagi driven element center section of said boom extend in a second pair of bores in said dipole center section of said Yagi driven element center section of said boom and into a second bore in each of said pair of Yagi driven element center sections of said Yagi driven element center section of said boom, respectively.

38. The kit of claim 37, wherein each antenna section includes a tube;

wherein said tube of each antenna section has said outboard end thereof, respectively; and wherein said tube of each antenna section has an inboard end thereof, respectively.

39. The kit of claim 38, wherein said tube of each antenna section is made from an alloy.

40. The kit of claim 39, wherein each antenna section includes a threaded insert; and wherein said threaded insert of each antenna section extends into said inboard end of an associated antenna section, and threads into both sides of said Yagi reflector/director end section of each Yagi reflector/director of said pair of Yagi reflectors/directors of said boom, respectively, and each of said pair of Yagi driven element center sections of said Yagi driven element center section of said boom, respectively.

41. The kit of claim 40, wherein said threaded insert of each antenna section is made from brass.

42. The kit of claim 41, wherein said threaded insert of each antenna section is maintained in said inboard end of an associated antenna section by a roll pin; and wherein said roll pin in said inboard end of an associated antenna section passes laterally through a bore in said inboard end of an associated antenna section, and a bore in said threaded insert of said associated antenna section.

43. The kit of claim 42, wherein said roll pin in said inboard end of an associated antenna section is made from stainless steel.

44. The kit of claim 43, wherein each antenna section includes a collar; and wherein said collar of each antenna section extends over said outboard end of an associated antenna section.

45. The kit of claim 44, wherein said collar of each antenna section is made from aluminum.

46. The kit of claim 45, wherein each antenna section includes a thumb screw; and wherein said thumb screw of each antenna section threads into a bore in said collar of an associated antenna section.

47. The kit of claim 46, wherein each another antenna section includes a tube; and wherein said tube of each another antenna section has said outboard end of said another pair of antenna sections and an inboard end.

48. The kit of claim 47, wherein said tube of each another antenna section is made from an alloy.

49. The kit of claim 48, wherein each another antenna section includes a threaded insert; and wherein said threaded insert of each another antenna section extends into said outboard end of an associated another antenna section.

50. The kit of claim 49, wherein said threaded insert of each another antenna section is made from brass.

51. The kit of claim 50, wherein said threaded insert of each another antenna section is maintained in said outboard end of an associated another antenna section by a roll pin; and wherein said roll pin in said outboard end of an associated another antenna section passes laterally through a bore in said out board end of an associated another antenna section and a bore in said threaded insert of said associated another antenna section.

52. The kit of claim 51, wherein said roll pin of each another antenna section is made from stainless steel.

53. The kit of claim 52, wherein said inboard end of said tube of each another antenna section telescopes into said collar of an associated antenna section.

54. The kit of claim 53, wherein each wound coil includes a Yagi coil tube; and wherein said Yagi coil tube of each wound coil has a pair of ends.

55. The kit of claim 54, wherein said Yagi coil tube of each wound coil is made from PVC.

56. The kit of claim 55, wherein each wound coil includes a wire coil;

wherein said wire coil of each wound coil winds around said Yagi tube of an associated wound coil; and wherein said wire coil of each wound coil winds terminates in a pair of looped ends.

57. The kit of claim 56, wherein said wire coil of each wound coil is maintained around said Yagi tube of an associated wound coil by a pair of screws; and wherein said pair of screws of each wound coil pass through said pair of looped ends of said wire coil of an associated wound coil, respectively, and through a pair of bores in said Yagi coil tube of said associated wound coil, respectively.

58. The kit of claim 57, wherein said pair of screws of each wound coil are made from stainless steel.

59. The kit of claim 58, wherein each wound coil includes a pair of coil end caps; and wherein said pair of coil end caps of each wound coil replaceably close said pair of ends of said Yagi coil tube of an associated wound coil, and are maintained thereat, by said pair of screws of said associated wound coil threading into diametrically-opposed and radially-oriented bores in each coil end cap of an associated wound coil, after passing through said bore in said Yagi coil tube of said associated wound coil.

60. The kit of claim 59, wherein said pair of coil end caps of each wound coil are made from aluminum.

61. The kit of claim 60, wherein each coil end cap of each wound coil includes a plug;

wherein said plug of each coil end cap of each wound coil is cylindrically shaped;

wherein said plug of each coil end cap of each wound coil has said diametrically-opposed and radially-oriented bores therein; and wherein said plug of each coil end cap of each wound coil plugs closed each end of said Yagi coil tube of an associated wound coil.

62. The kit of claim 61, wherein each coil end cap of each wound coil includes a flange;

wherein said flange of each coil end cap of each wound coil is concentrically disposed on an outboard end of, and is wider than, said plug of an associated coil end cap of an associated wound coil; and wherein said flange of each coil end cap of each wound coil rests on said end of said Yagi coil tube of said associated wound coil.

63. The kit of claim 62, wherein each coil end cap of each wound coil includes a threaded through bore;

wherein said threaded through bore in each coil cap of each wound coil extends centrally and axially through said flange of an associated coil end cap of an associated wound coil and said plug of said associated coil end cap of said associated wound coil;

wherein an inboard end cap of each wound coil threadably receives said out board end of an associated another antenna section; and wherein an outboard end cap of said associated wound coil threadably receives said still another antenna section.

64. The kit of claim 63, wherein each coupling includes a sleeve;

wherein said sleeve of each coupling is hexagonally shaped in cross section; and wherein said sleeve of each coupling has a pair of threaded bores extending axially therethrough terminating in said outboard end of an associated coupling and an inboard end of said associated coupling.

65. The kit of claim 64, wherein said inboard end of each coupling threadably receives said out board end of an associated another antenna section; and wherein said outboard end of said associated coupling threadably receives said still another antenna section.

66. The kit of claim 65, wherein each still another antenna section includes a tube; and wherein said tube of each still another antenna section has an outboard end and an inboard end.

67. The kit of claim 66, wherein said tube of each still another antenna section is made from an alloy.

68. The kit of claim 67, wherein each still another antenna section includes a threaded insert; and wherein said threaded insert of each still another antenna section extends into said inboard end of an associated still another antenna section, and threads into one of said outboard end of said pair of wound coils and said outboard end of said pair of couplings, respectively.

69. The kit of claim 68, wherein said threaded insert of each still another antenna section is made from brass.

70. The kit of claim 69, wherein said threaded insert of each still another antenna section is maintained in said inboard end of an associated still another antenna section by a roll pin; and wherein said roll pin in said inboard end of an associated still another antenna section passes laterally through a bore in said inboard end of an associated still another antenna section, and a bore in said threaded insert of said associated still another antenna section.

71. The kit of claim 70, wherein said roll pin in said inboard end of an associated still another antenna section is made from stainless steel.

72. The kit of claim 71, wherein each still another antenna section includes a collar; and wherein said collar of each still another antenna section extends over said outboard end of an associated still another antenna section.

73. The kit of claim 72, wherein said collar of each still another antenna section is made from aluminum.

74. The kit of claim 73, wherein each still another antenna section includes a thumb screw; and wherein said thumb screw of each still another antenna section threads into a bore in said collar of an associated still another antenna section.

75. The kit of claim 74, wherein said mast to boom assembly of said boom includes a boom mounting plate; and wherein said boom mounting plate of said mast to boom assembly of said boom has:

a) two pair of primary through bores; and b) two pair of secondary through bores.

76. The kit of claim 75, wherein said boom mounting plate of said mast to boom assembly of said boom is made from aluminum.

77. The kit of claim 76, wherein said mast to boom assembly of said boom includes a pair of boom clamps;

wherein said pair of boom clamps of said mast to boom assembly of said boom receive said boom center section tube of said mast to boom driven element boom center section of said boom; and wherein said pair of boom clamps of said mast to boom assembly of said boom are maintained against a boom facing side of said boom mounting plate of said mast to boom assembly of said boom by two pair of screws that pass through two pair of washers, through said two pair of secondary through bores in said boom mounting plate of said mast to boom assembly of said boom, and threadably into said pair of boom clamps of said mast to boom assembly of said boom.

78. The kit of claim 77, wherein said boom center section tube of said mast to boom driven element boom center section of said boom is maintained in said pair of boom clamps of said mast to boom assembly of said boom by a pair of clamp screws that thread through through bores in said pair of boom clamps of said mast to boom assembly of said boom, respectively, and bear against said boom center section tube of said mast to boom driven element boom center section of said boom.

79. The kit of claim 78, wherein said two pair of screws of said mast to boom assembly of said boom, said two pair of washers of said mast to boom assembly of said boom, and said pair of clamp screws of said mast to boom assembly of said boom are made from stainless steel.

80. The kit of claim 79, wherein said mast to boom assembly of said boom includes:

a) a pair of U-bolts;

b) a pair of clamp bases; and c) two pair of nuts.

81. The kit of claim 80, wherein said pair of U-bolts of said mast to boom assembly of said boom receive said pair of clamp bases of said mast to boom assembly of said boom, respectively, pass through said two pair of primary through bores in said boom mounting plate of said mast to boom assembly of said boom, respectively, from a mast facing side of said boom mounting plate of said mast to boom assembly of said boom, and threadably engage in said two pair of nuts of said mast to boom assembly of said boom, respectively; and wherein said pair of U-bolts of said mast to boom assembly of said boom are for receiving the mast for attaching said assembled Yogi antenna kit to the mast.

82. The kit of claim 81, further comprising a tuner; and wherein said tuner extends from said driven element in a general direction of said boom.

83. The kit of claim 82, wherein said tuner includes a pair of hairpin rods; and wherein each of said pair of hairpin rods of said tuner has:

a) an inboard end; and b) an outboard end.

84. The kit of claim 83, wherein each of said pair of hairpin rods of said tuner is a ⅛" brass rod.

85. The kit of claim 84, wherein said inboard end of each of said pair of hairpin rods of said tuner is formed into a ring lug; and wherein said ring lug of each of said pair of hairpin rods of said tuner receives said threaded insert of an associated antenna section as said threaded insert of said associated antenna section threads into each of said pair of Yagi driven element center sections of said Yagi driven element center section of said boom, respectively.

86. The kit of claim 85, wherein said ring lug of each of said pair of hairpin rods of said tuner is ⅜" in diameter.

87. The kit of claim 86, wherein said tuner includes a shortening rod;

wherein said shortening rod of said tuner has a pair of through bores; and wherein said pair of through bores of said shortening rod of said tuner receive said outboard end of each of said pair of hairpin rods of said tuner, respectively, in such a manner so as to maintain said pair of hairpin rods of said tuner parallel to said mast to boom driven element boom center section of said boom.

88. The kit of claim 87, wherein said shortening rod of said tuner includes a pair of thumb wheels; and wherein said pair of thumb wheels of said shortening rod of said tuner threadably engages against said pair of hairpin rods of said tuner to thereby maintain said shortening rod of said tuner on said pair of hairpin rods of said tuner at a position commensurate with band chosen.

89. The kit of claim 88, wherein each of said reflector element, said driven element, and said director element includes one of a pair of long terminal antenna sections and a pair of short terminal antenna sections.

90. The kit of claim 89, wherein one of said pair of long terminal antenna sections and said pair of short terminal antenna sections extend from said pair of still another antenna sections, respectively, depending upon desired length due to available space.

91. The kit of claim 90, further comprising:

a) a carrying case; and b) a tape measure.

92. The kit of claim 91, wherein said carrying case holds said mast to boom driven element boom center section of said boom, said pair of boom end section assemblies of said boom, said pair of antenna sections, said pair of another antenna sections, said pair of still another antenna sections, said pair of wound coils, said pair of couplings, said tape measure, said pair of hairpin rods of said tuner, said shortening rod of said tuner, said pair of long terminal antenna sections, and said pair of short terminal antenna sections.

93. A method of assembling a portable Yagi antenna kit, comprising the steps of:

a) choosing a band to operate in prior to assembly;

b) laying out a mast to boom driven element boom center section of a boom and a pair of boom end section assemblies of the boom;

c) assembling the boom;

d) laying out:

i) a pair of antenna sections of each of a reflector element, a driven element, and a director element;

ii) a pair of another antenna sections of each of the reflector element, the driven element, and the director element;

iii) a pair of still another antenna sections of each of the reflector element, the driven element, and the director element; and iv) a pair of long terminal antenna sections of each of the reflector element, the driven element, and the director element or a pair of short terminal antenna sections of each of the reflector element, the driven element, and the director element;

e) assembling together:

i) the pair of antenna sections of each of the reflector element, the driven element, and the director element;

ii) the pair of another antenna sections of each of the reflector element, the driven element, and the director element;

iii) the pair of still another antenna sections of each of the reflector element, the driven element, and the director element; and iv) the pair of long terminal antenna sections of each of the reflector element, the driven element, and the director element or the pair of short terminal antenna sections of each of the reflector element, the driven element, and the director element;

f) determining if 2GM is being used;

g) using only a pair of wound coils of each of the reflector element, the driven element, and the director element, if answer to step f) is yes;

h) setting exposed length of:

i) the pair of antenna sections of each of the reflector element, the driven element, and the director element;

ii) the pair of another antenna sections of each of the reflector element, the driven element, and the director element;

iii) the pair of still another antenna sections of each of the reflector element, the driven element, and the director element; and iv) the pair of long terminal antenna sections of each of the reflector element, the driven element, and the director element or the pair of short terminal antenna sections of each of the reflector element, the driven element, and the director element using a tape measure;

i) screwing the reflector element and the director element into a pair of Yagi reflectors/directors of the boom, respectively;

j) screwing the driven element into a Yagi driven element center section of the boom;

k) ascertaining that the reflector element is placed at the correct spacing to the driven element;

l) inserting a threaded insert of each antenna section of the driven element through a ring lug of a pair of hairpin rods of a tuner, respectively, and then screwing the threaded insert of each antenna section of the driven element into a pair of Yagi driven element center sections of the Yagi driven element center section of the boom, respectively;

m) aligning the pair of hairpin rods of the tuner parallel with the boom;

n) installing a shortening rod of the tuner on the pair of hairpin rods of the tuner;

o) using the shortening rod of the tuner to set the pair of hairpin rods of the tuner to a proper length for band chosen;

p) plugging in a double banana plug of the Yagi driven element center section of the boom to an BNC adapter;

q) attaching a feed line;

r) mounting the assembled Yagi antenna kit on an appropriate mast as high as possible;

s) determining if the assembled Yagi antenna kit is placed 15 to 20 feet above ground;

t) ascertaining that a best match is very close to center of the band or band segment chosen, if answer to step s) is yes; and u) making small adjustments to the pair of long terminal antenna sections of each of the reflector element, the driven element, and the director element or the pair of short terminal antenna sections of each of the reflector element, the driven element, and the director element to bring match to a desired frequency.

94. The method of claim 93, further comprising the steps of:

v) determining if large frequency shifts are required;

w) finding a frequency where the assembled Yagi antenna kit is working properly, if answer to step v) is yes;

x) dividing the frequency by a new frequency;

y) measuring half length;

z) adjusting each of the pair of long terminal antenna sections of each of the reflector element, the driven element, and the director element or the pair of short terminal antenna sections of each of the reflector element, the driven element, and the director element to achieve a new element half length of the reflector element, the driven element, and the director element; and aa) making small improvements in frequency and VSWR by adjusting the pair of long terminal antenna sections or the pair of short terminal antenna sections of the driven element slightly.

95. The method of claim 94, further comprising the steps of:

bb) determining if a same band is going to be used over and over again; and cc) marking dimension with a permanent felt pen marker and note the band next to the marks to speed up reassembly at the next site, if answer to step bb) is yes.

96. The method of claim 95, further comprising the step of engraving dimensions into the pair of antenna sections of each of the reflector element, the driven element, and the director element, the pair of another antenna sections of each of the reflector element, the driven element, and the director element, the pair of still another antenna sections of each of the reflector element, the driven element, and the director element, the pair of long terminal antenna sections of each of the reflector element, the driven element, and the director element, and the pair of short terminal antenna sections of each of the reflector element, the driven element, and the director element.

* * * * *